US009828162B2

(12) United States Patent
Bachman et al.

(10) Patent No.: US 9,828,162 B2
(45) **Date of Patent: *Nov. 28, 2017**

(54) COMPONENTS TO ALLOW BUCKETS TO BE USED AS STRUCTURAL OR ALTERNATIVE ELEMENTS

(71) Applicant: Primordial Soup, LLC, Saint Paul, MN (US)

(72) Inventors: Tim Bachman, Saint Paul, MN (US); Matthew Vail Leyden, Saint Paul, MN (US); Christian Richard Trifilio, Saint Paul, MN (US); Jeff Waffensmith, Minneapolis, MN (US); Rod St. Michel, Mendota Heights, MN (US)

(73) Assignee: Primordial Soup, LLC, Saint Paul, MN (US)

( * ) Notice: Subject to any disclaimer, the term of this patent is extended or adjusted under 35 U.S.C. 154(b) by 397 days.

This patent is subject to a terminal disclaimer.

(21) Appl. No.: 14/630,632

(22) Filed: Feb. 24, 2015

(65) Prior Publication Data

US 2015/0166243 A1 Jun. 18, 2015

Related U.S. Application Data

(63) Continuation-in-part of application No. 13/499,539, filed as application No. PCT/US2010/050885 on Sep. 30, 2010, now Pat. No. 8,992,111.

(60) Provisional application No. 61/247,337, filed on Sep. 30, 2009.

(51) Int. Cl.
*B65D 81/36* (2006.01)
*B65D 21/02* (2006.01)

(52) U.S. Cl.
CPC ..... *B65D 81/361* (2013.01); *B65D 21/0224* (2013.01); *Y10T 403/551* (2015.01)

(58) Field of Classification Search
CPC ..... A47C 7/022; A47C 7/021; A47C 15/004; A47C 11/00; E04G 1/00; E04G 1/32; E04G 1/17
See application file for complete search history.

(56) References Cited

U.S. PATENT DOCUMENTS

| | | | |
|---|---|---|---|
| 2,849,110 | A | 8/1958 | Weiss |
| 4,116,332 | A | 9/1978 | Hartley |
| 4,256,240 | A | 3/1981 | Woinarski |
| 4,420,093 | A | 12/1983 | Von Holdt |
| 4,487,135 | A | 12/1984 | Van Ryn |
| 4,780,048 | A | 10/1988 | Perry |

(Continued)

FOREIGN PATENT DOCUMENTS

| | | | |
|---|---|---|---|
| DE | 4204242 | A1 | 8/1993 |
| GB | 2161199 | A | 1/1986 |

(Continued)

OTHER PUBLICATIONS

Daniel J Wiley; Non-Final Office Action for U.S. Appl. No. 13/499,539; U.S. Communication, dated Jun. 30, 2014.

(Continued)

*Primary Examiner* — Daniel Wiley
(74) *Attorney, Agent, or Firm* — Grumbles Law PLLC; Brittany Nanzig

(57) ABSTRACT

A set of connectors connects buckets, such as five-gallon buckets, to each other, to the ground, to dimensional lumber, and/or to pipe for the purpose of producing objects such as benches, stepstools, tables, sawhorses, shelters, platforms, etc.

24 Claims, 37 Drawing Sheets

(56) References Cited

U.S. PATENT DOCUMENTS

| | | | |
|---|---|---|---|
| 4,846,076 | A | 7/1989 | Menges |
| 4,867,332 | A | 9/1989 | Mains |
| 4,899,885 | A | 2/1990 | Van Koert |
| 4,911,295 | A | 3/1990 | Venegoni |
| 4,925,026 | A | 5/1990 | McKay |
| 4,966,298 | A | 10/1990 | Von Holdt |
| 4,982,858 | A | 1/1991 | Von Holdt |
| 4,993,551 | A | 2/1991 | Lindsay |
| 5,086,917 | A | 2/1992 | Dziersk et al. |
| 5,088,618 | A | 2/1992 | Colombo |
| 5,186,329 | A | 2/1993 | Fogelberg |
| 5,261,556 | A | 11/1993 | Gatto |
| 5,279,841 | A | 1/1994 | Yu |
| 5,322,183 | A | 6/1994 | Strachan |
| 5,657,871 | A | 8/1997 | Waters et al. |
| 5,938,276 | A | 8/1999 | Munoz et al. |
| 6,059,109 | A | 5/2000 | Stein |
| 6,126,029 | A | 10/2000 | Storgaard |
| 6,164,481 | A | 12/2000 | Geeham |
| 6,536,590 | B1 | 3/2003 | Godshaw et al. |
| 7,192,082 | B2 | 3/2007 | Tennian |
| 7,380,665 | B2 | 6/2008 | Ohms |
| 8,360,265 | B1 | 1/2013 | Andrews |
| 2003/0006156 | A1 | 1/2003 | McCracken et al. |
| 2004/0079587 | A1 | 4/2004 | Brady |
| 2004/0226841 | A1 | 11/2004 | Ginder, Jr. |
| 2006/0113310 | A1 | 6/2006 | Hawkins |

FOREIGN PATENT DOCUMENTS

| | | | |
|---|---|---|---|
| GB | 2274870 | A | 10/1994 |
| GB | 2316974 | A | 11/1998 |
| WO | 2006059058 | A1 | 6/2006 |

OTHER PUBLICATIONS

Examination Report from Canadian Patent Application No. 2,776,166, dated Jul. 7, 2016, 3 pp.

FIG. 17c
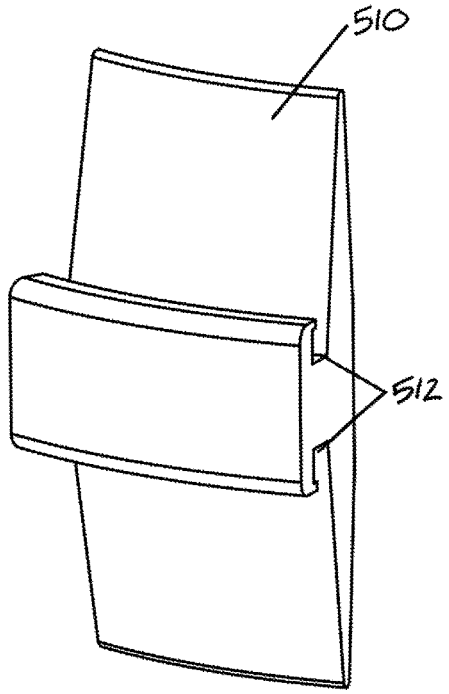
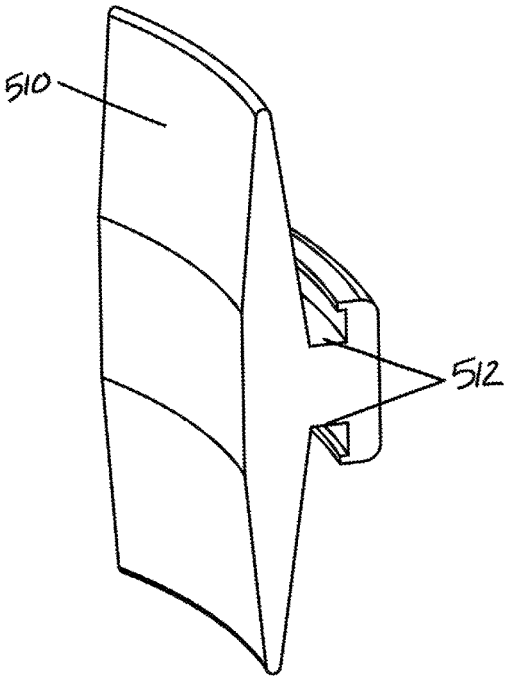
FIG. 17b

COMPONENTS TO ALLOW BUCKETS TO BE USED AS STRUCTURAL OR ALTERNATIVE ELEMENTS

RELATED APPLICATIONS

This application is a continuation-in-part of U.S. patent application Ser. No. 13/499,539, filed on Mar. 30, 2012, titled COMPONENTS TO ALLOW BUCKETS TO BE USED AS STRUCTURAL OR ALTERNATIVE ELEMENTS, which is a national stage application of PCT International Application Serial No. PCT/US10/50885, filed on Sep. 30, 2010, titled COMPONENTS TO ALLOW BUCKETS TO BE USED AS STRUCTURAL OR ALTERNATIVE ELEMENTS, which claims the benefit of U.S. Provisional Application 61/247,337, filed on Sep. 30, 2009, titled COMPONENTS TO ALLOW BUCKETS TO BE USED AS STRUCTURAL OR ALTERNATIVE ELEMENTS.

BACKGROUND

The five-gallon bucket is a common item at construction sites, garages, and in the backs of pickup trucks all over the country. Originally intended to ship bulk quantities of food for the foodservice industry or bulk quantities of spackling etc. for the construction industry, people have found that there are several additional uses for the buckets. Such uses include using them to hold paint to use with a roller to holding bait for fishing. The result is that these buckets are readily available at home improvement stores to purchase as well as there being a large volume of buckets in the field that have been repurposed and are being re-used after their initial use has expired.

The five-gallon bucket, although thin and made of plastic, is a relatively strong component that can easily support a 200 plus pound man sitting on top of it. In addition, the buckets are lightweight, stackable, and store easily.

SUMMARY

The disclosure relates to a set of connectors that connect buckets, such as five gallon buckets, to each other, to the ground, to dimensional lumber and/or to pipe for the purpose of producing objects such as benches, stepstools, tables, sawhorses, shelters, platforms, etc.

DESCRIPTION OF THE FIGURES

FIG. 17*b* shows a perspective view of a single connector of FIG. 17.

FIG. 17*c* shows a perspective view of a single connector of FIG. 17.

DETAILED DESCRIPTION

Figure 1:
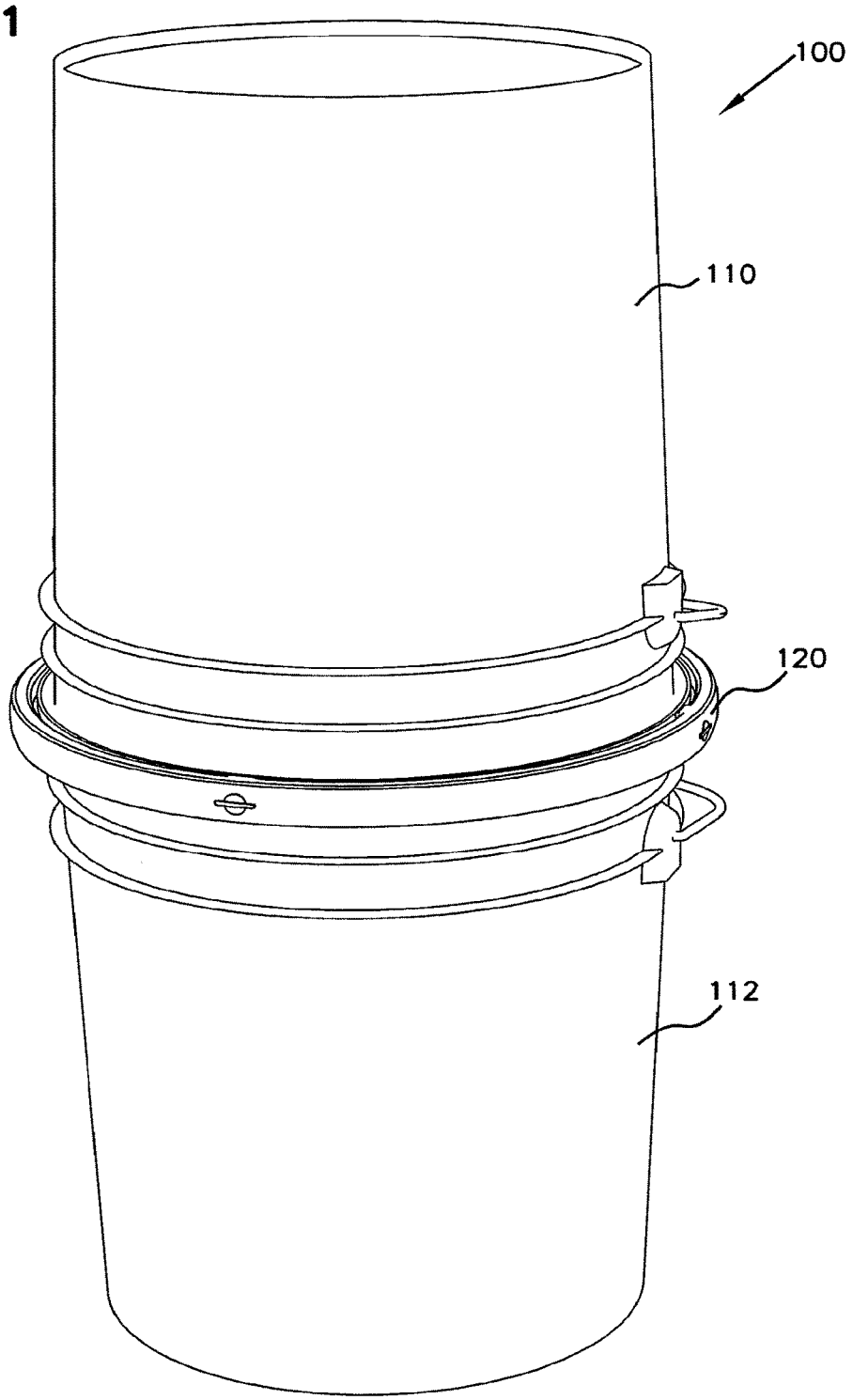
FIG. 1 shows two buckets connected by an example connector.

The present disclosure relates to connectors that couple five gallon buckets to each other, to the ground, to dimensional lumber and/or to pipe for the purpose of producing useful objects such as benches, stepstools, tables, sawhorses, shelters, and platforms. Five gallon buckets have the following standard size dimensions of height: 14.5 inches to 15.6 inches; top diameter: 11.75 inches to 13 inches; bottom diameter: 10.0 inches to 10.5 inches; top circumference of about 37.0 inches; bottom circumference of about 32.0; and wall thickness of about 0.09 inches. In some embodiments, the connectors can connect buckets of other sizes.

By using the connectors described herein, the buckets can do the same jobs as traditional sawhorses, concrete blocks, metal scaffolding, and workmate-style benches, as well as have additional utility.

The connectors themselves may be primitive devices that perform a single function or may be composite devices that can perform more than one primitive function. The primitive devices include bucket-to-bucket connections, bucket-to-ground connections, bucket-to-lumber connections, bucket-to-pipe connections, and connector-to-connector connections.

The example connectors disclosed herein work by allowing a user to do one or more of the following, while still retaining the integrity of the bucket. In some examples, this can be accomplished without tools or modifications needed to the buckets themselves.

Examples of such uses include:

Attach two buckets to each other either top to bottom, top to top, bottom to bottom, or side to side;

Attach a bucket to plywood or sheathing;

Attach a bucket to flat ground securely;

Attach a bucket to uneven ground;

Attach a bucket to dimensional lumber such as a 2×4; and

Attach a bucket to pipe easily such as 4" diameter PVC pipe.

With the ability to make the above connections quickly, the user can create structural elements that can be configured intuitively and quickly to build a variety of elements that could include:

short or tall workbench or table;

scaffolding;

stage;

wood stacking platform;

sawhorses—infinitely adjustable in length and width;

portable set up for painting;

garage or work-site shelves;

bench;

work hammock;

non-flat storage;

scaffold on a hill or incline;

tarp tent to cover boats, etc.;

greenhouse cover for gardens;

soccer or other sports goal;

work light supports;

temporary shelters;

volleyball net;

scaffolding adapted to stairs; and bridge (e.g., to cross a body of water, like a creek).

The connectors can be sold in kits that allow the connectors to be used to assemble different structures.

In addition to the above, the buckets can be filed with rocks, water, sand, etc., to add stability. The buckets can also still be used to hold tools, lights, screws, etc. when used alone or structurally, as shown in several of the figures.

Example configurations are reflected in FIGS. 1-34. These figures reflect the multiple different configurations that could be used to create the connector. Some examples are:

a solid "ring" that the bucket snaps into that facilitates connecting the buckets and structural elements—see, e.g., FIGS. 5-11 and 16; and "stick" or "block" shaped elements that attach to the bucket bottom or top that can be used alone or can be attached to additional "sticks" to create additional utility—see, e.g., FIGS. 17-21.

Figure 2:
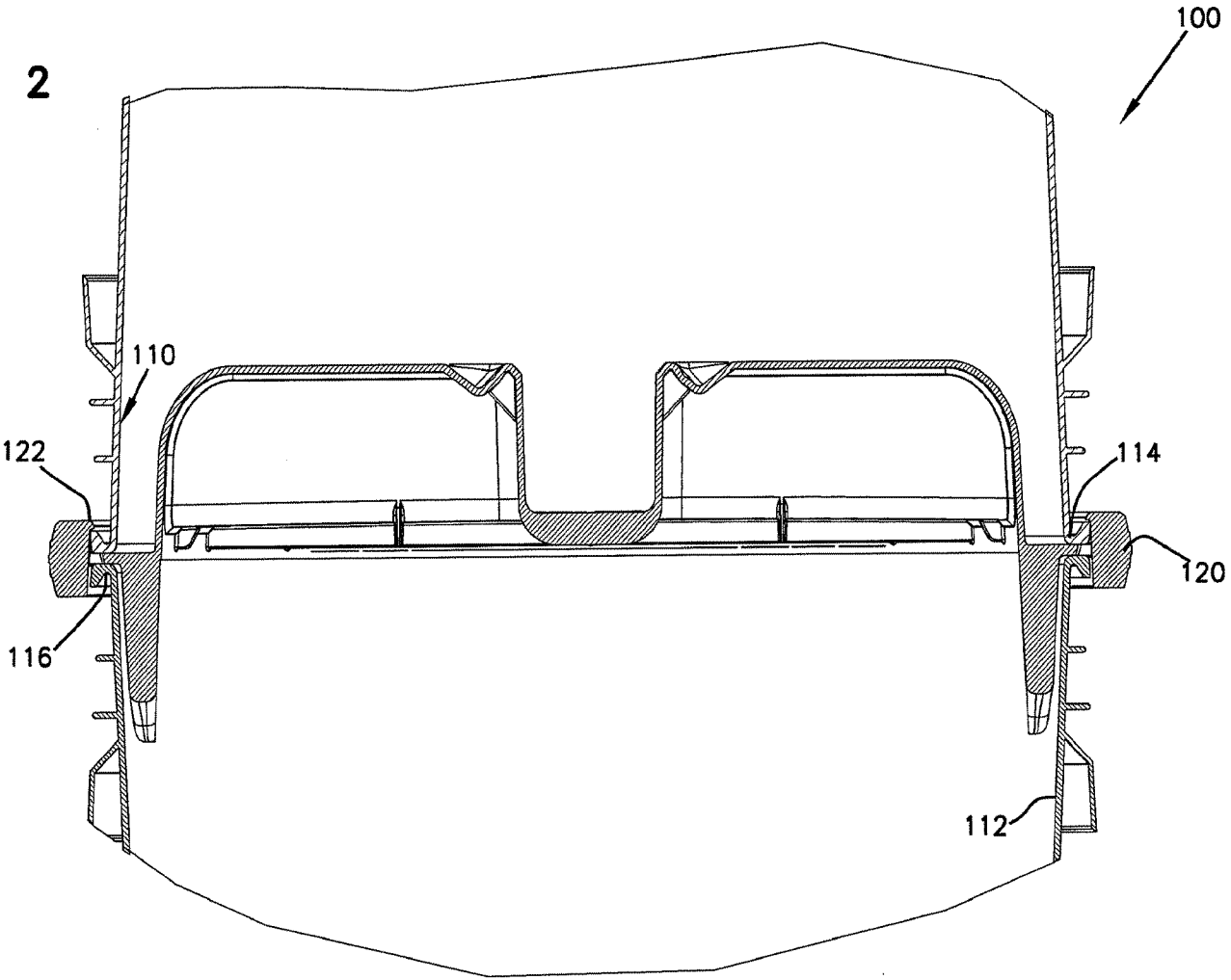
FIG. 2 shows a cross-section of a portion of the buckets and connector of FIG. 1.

Referring now to FIGS. 1 and 2, there are many methods by which a connector can be attached to a bucket. One method of attachment is to snap the connector on in the same manner that a bucket lid snaps on. Since the bucket has a slight taper, the connector can be press fit into place on the bucket. Additionally, latches, straps, screws, etc. could be used.

In FIG. 1, a first five-gallon bucket 110 is coupled to a second, inverted bucket 112 using a connector 120. Generally, the connector 120 engages each of the buckets 110, 112 similar to that of a lid to couple the connector 120 to each of the buckets 110, 112.

As shown in FIG. 2, the connector 120 includes a groove 115 into which an open-end surface 114, 116 of each of the buckets 110, 112 can be inserted to form a structure 100. A lip 122 formed by the connector 120 engages the surface 114 of the bucket 110 to connect the bucket 110 to the connector 120.

In this example, the structure 100 can be used for many of the applications described above, such a scaffolding, part of a sawhorse, etc.

Figure 3:
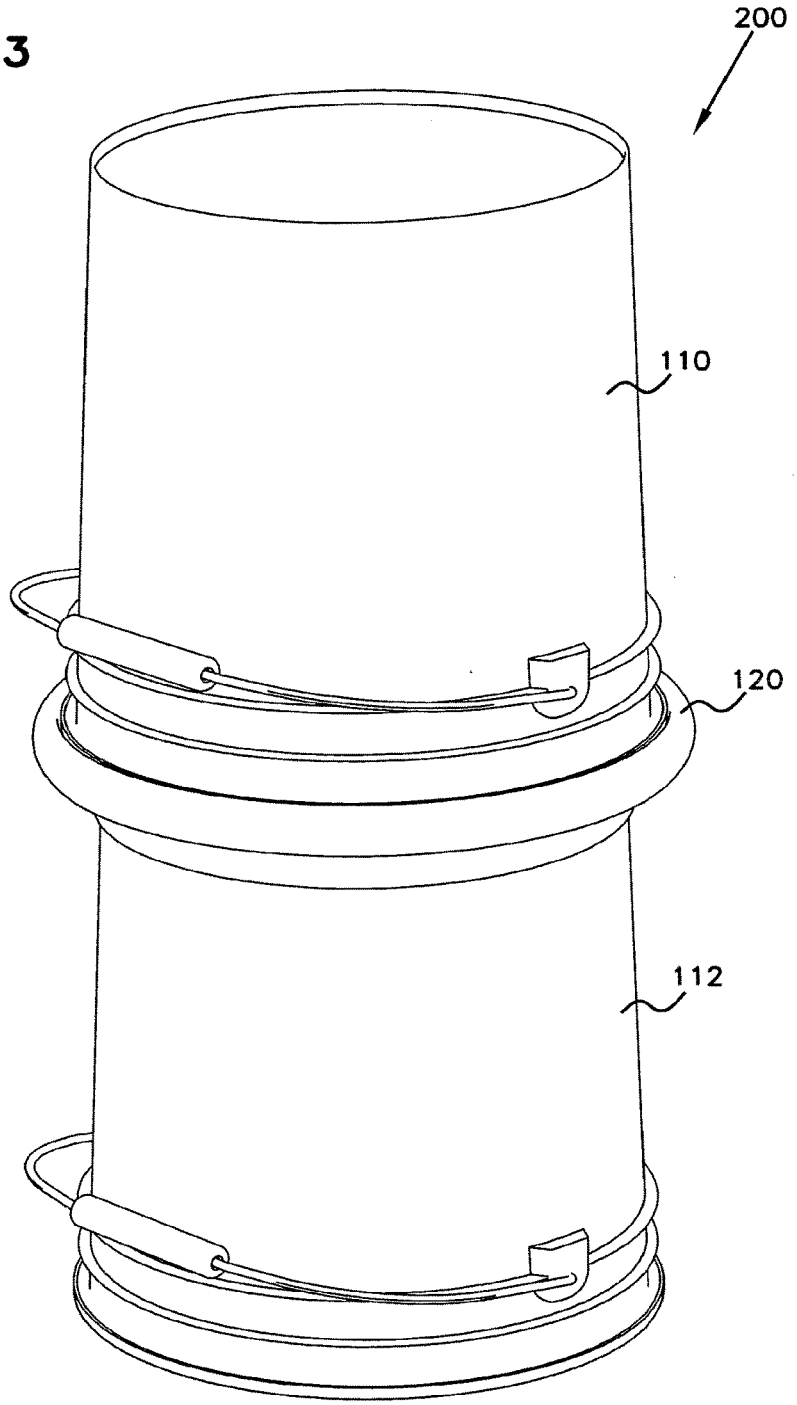
FIG. 3 shows two buckets connected by an example connector.
Figure 4:
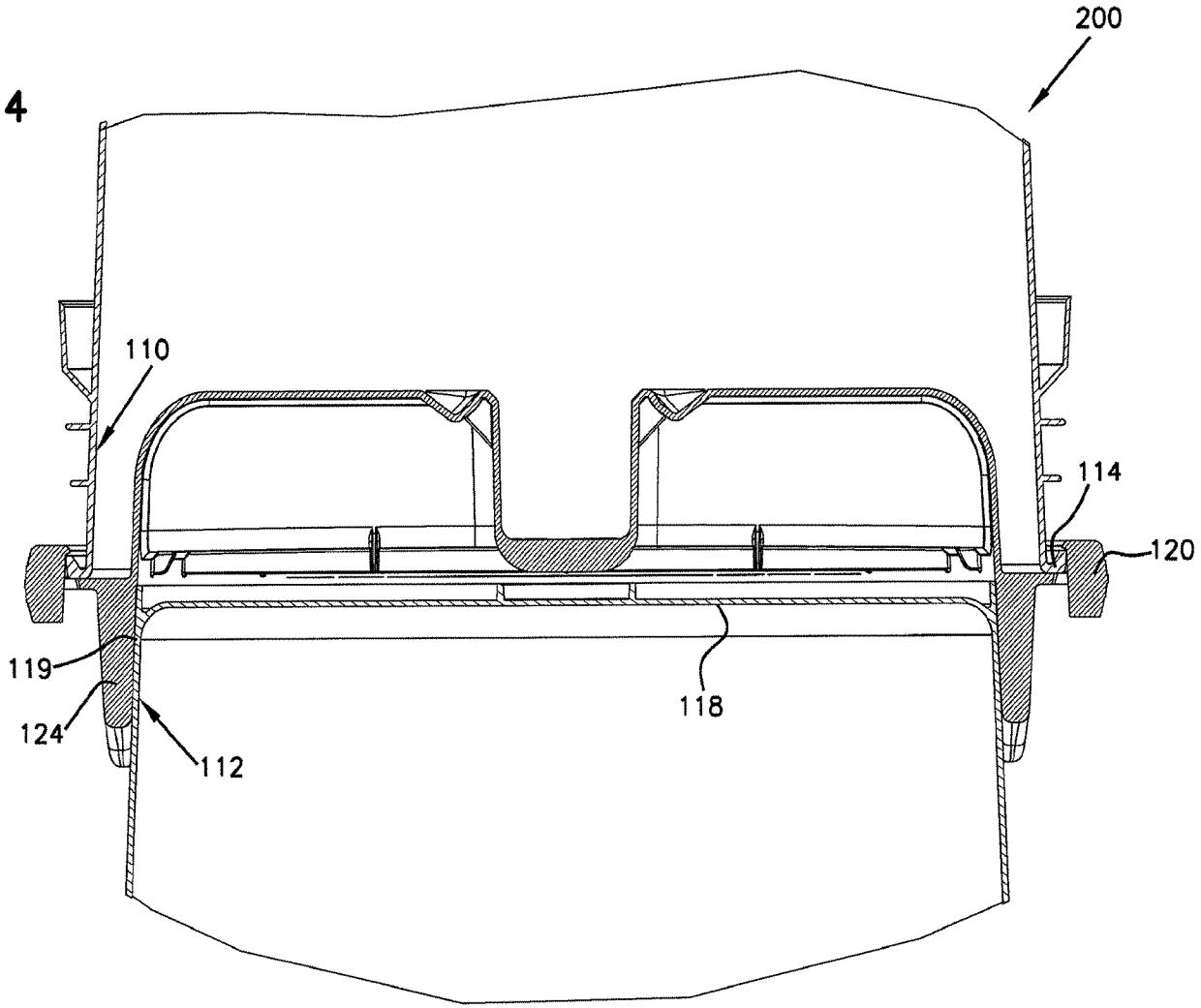
FIG. 4 shows a cross-section of a portion of the buckets and the connector of FIG. 3.
Figure 5:
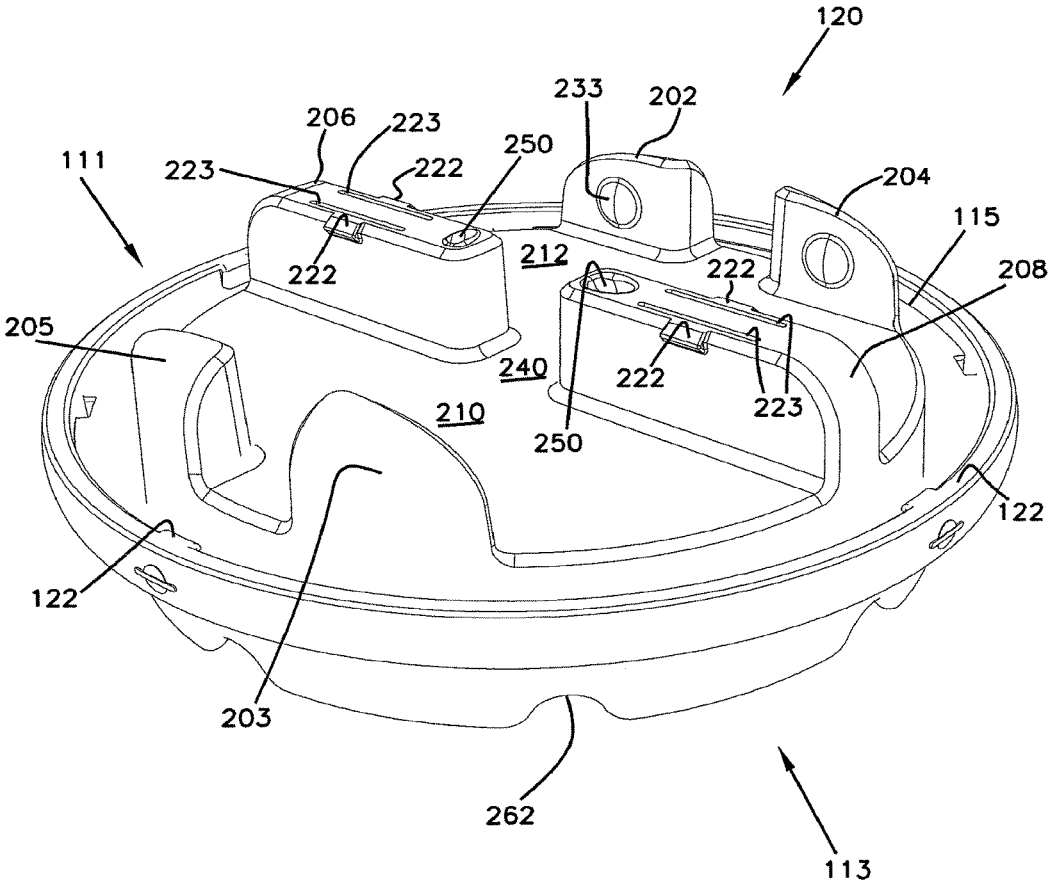
FIG. 5 shows a top perspective view of the example connector of FIG. 1.
Figure 6:
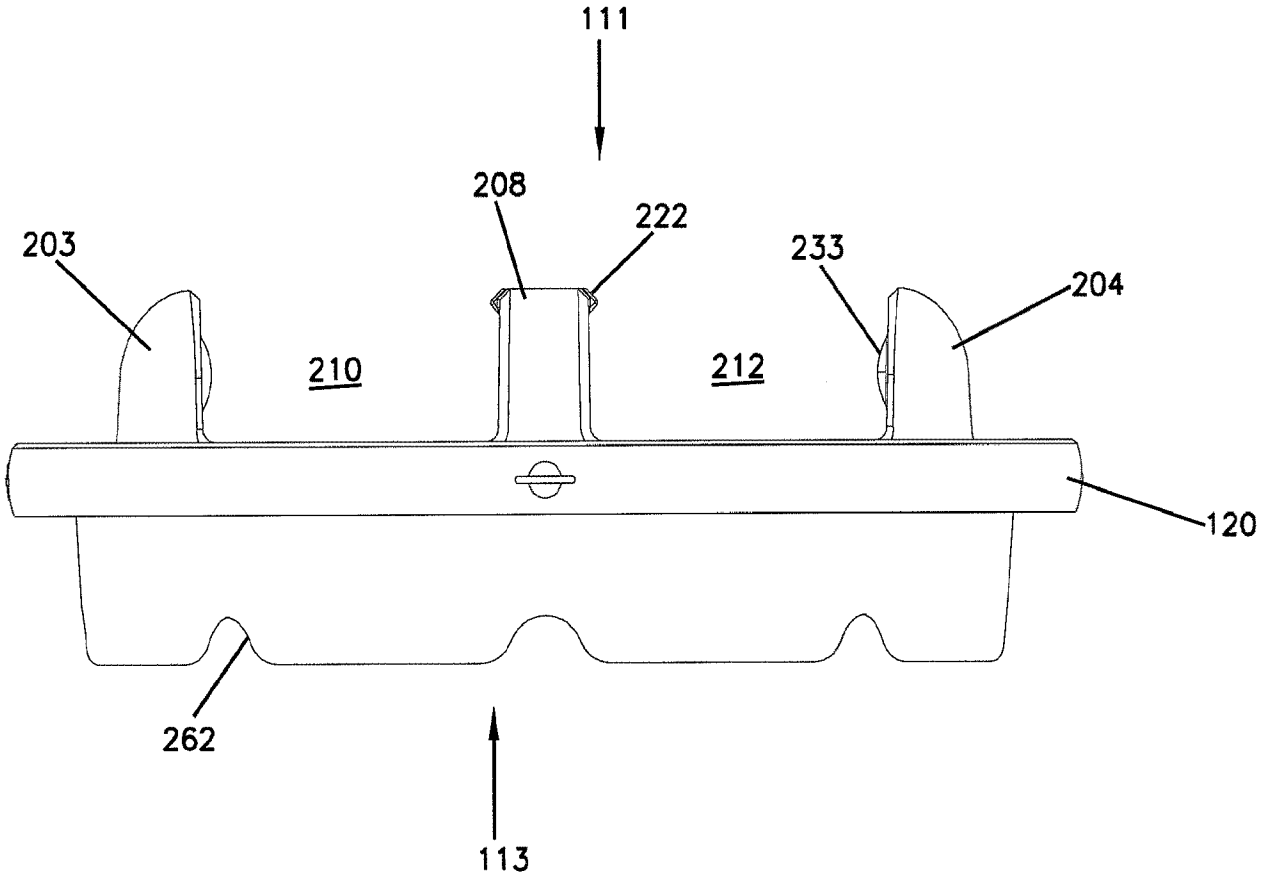
FIG. 6 shows a side view of the connector of FIG. 5.
Figure 7:
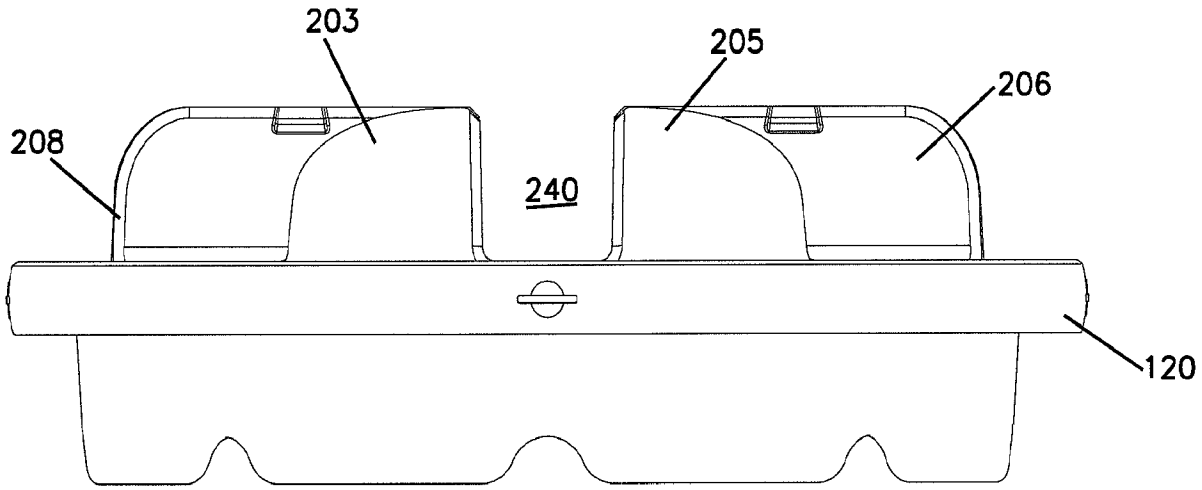
FIG. 7 shows an end view of the connector of FIG. 5.
Figure 8:
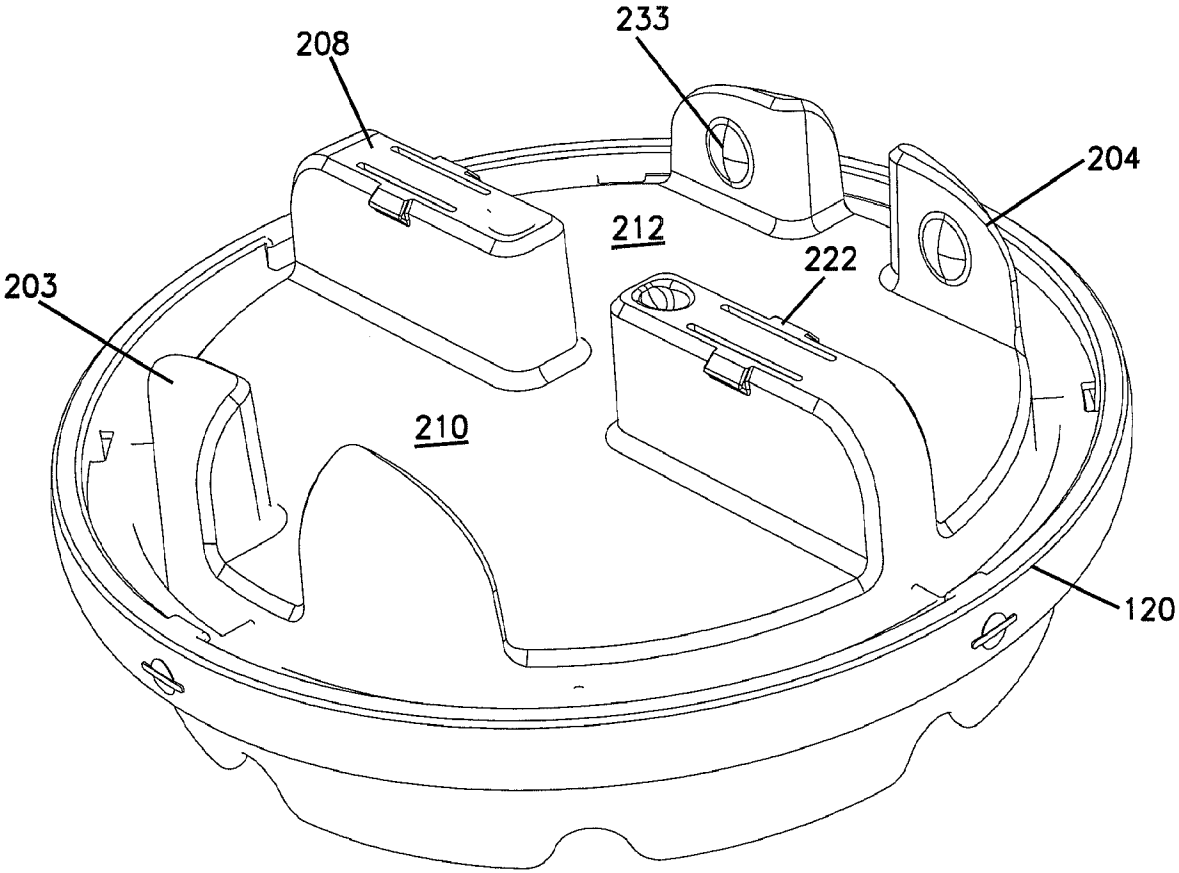
FIG. 8 shows another top perspective view of the connector of FIG. 5.
Figure 9:
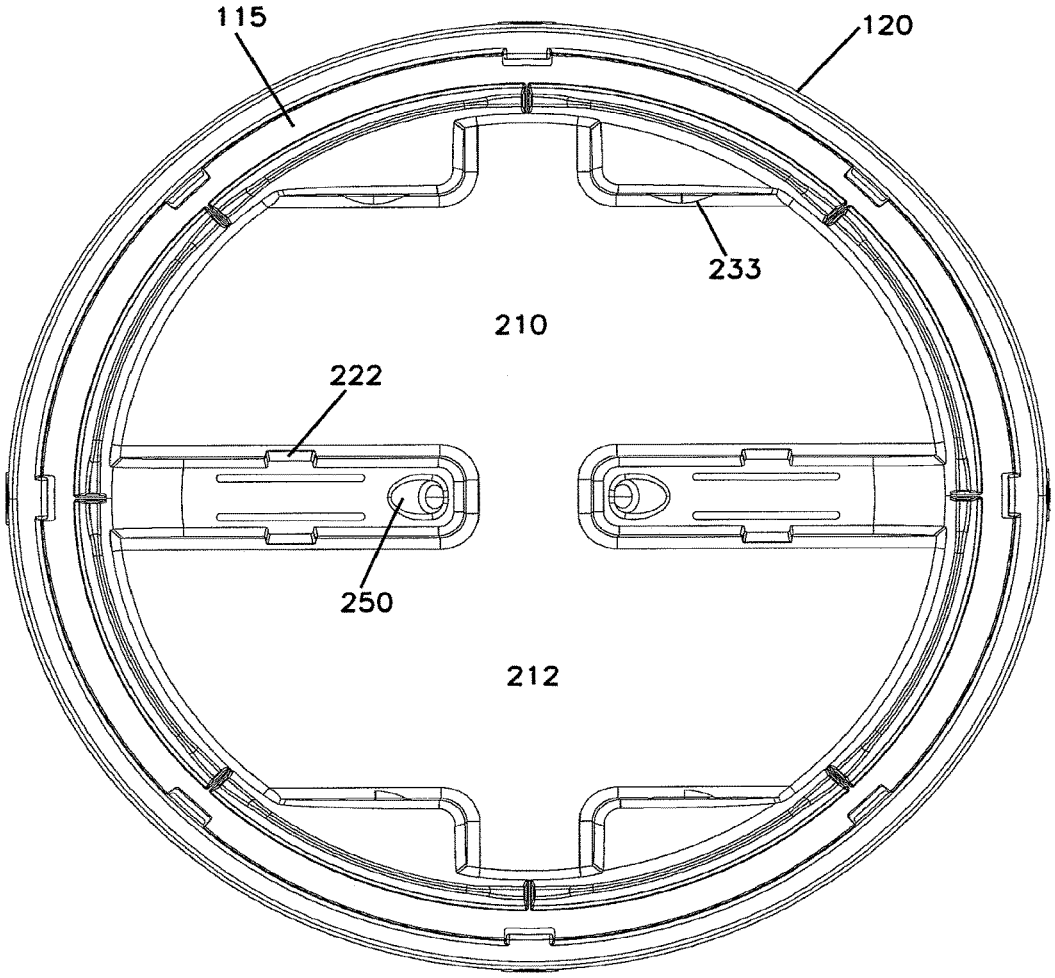
FIG. 9 shows a top view of the connector of FIG. 5.
Figure 10:
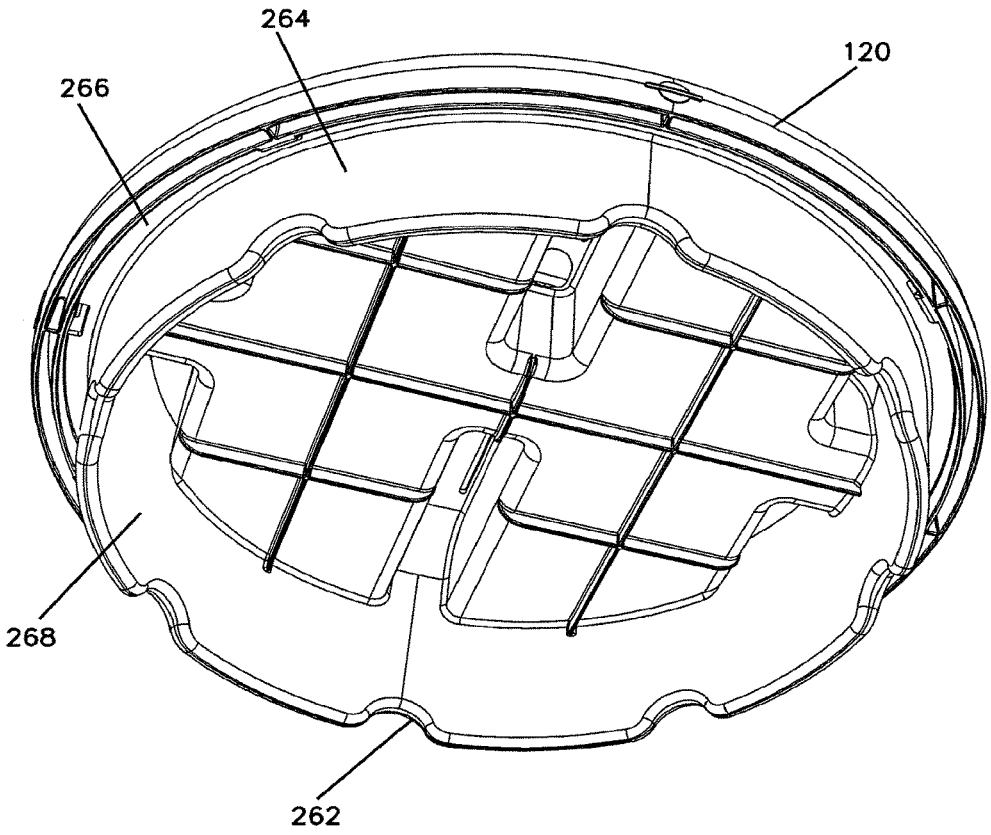
FIG. 10 shows a bottom perspective view of the connector of FIG. 5.
Figure 11:
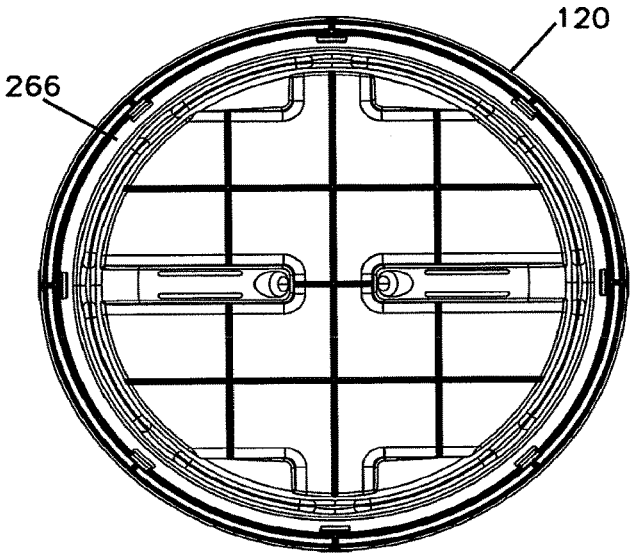
FIG. 11 shows a bottom view of the connector of FIG. 5.

For example, as shown in FIGS. 3 and 4, a structure 200 is created with the bucket 112 inverted so that a closed end 118 of the bucket 112 is connected to the connector 120. Member 124 formed by the connector 120 engages an outer surface 119 of the closed end 118 to connect the bucket 112 to the connector 120.

Referring now to FIGS. 5-11, the connector 120 is shown in isolation. The connector 120 includes several features that allow the connector 120 to be used in a variety of contexts. The connector 120 is one example of a composite device capable of performing more than one primitive function.

The connector 120 has a first connector side 111 and a second connector side 113. The connector 120 includes two parallel slots 210, 212 formed by protrusions 202, 203, 204, 205, 206, 208 for holding a cross member, such as a piece of 2×4 dimensional lumber of any length, securely in the horizontal orientation (with the 4" dimension parallel to the ground). Tabs 222 are formed on protrusions 206, 208 and extend into the slots 210, 212 to capture the lumber to couple the lumber to the connector 120. Relief apertures 223 are formed behind the tabs 222 within the protrusions 206, 208 to allow the tabs 222 to flex so that the lumber can be "snapped in" to the slots 210, 212 easily yet contain the lumber securely once in place. In other words, the relief apertures 223 allow the tabs 222 to "flex" so the tabs 222 can move out of the way to let the board pass into and out of the slots 210, 212. In addition, dimples 233 are formed to allow for the connector 120 to snugly grip dimensional 2×4 lumber with varying widths due to normal manufacturing variations, moisture content, etc.

Figure 12:
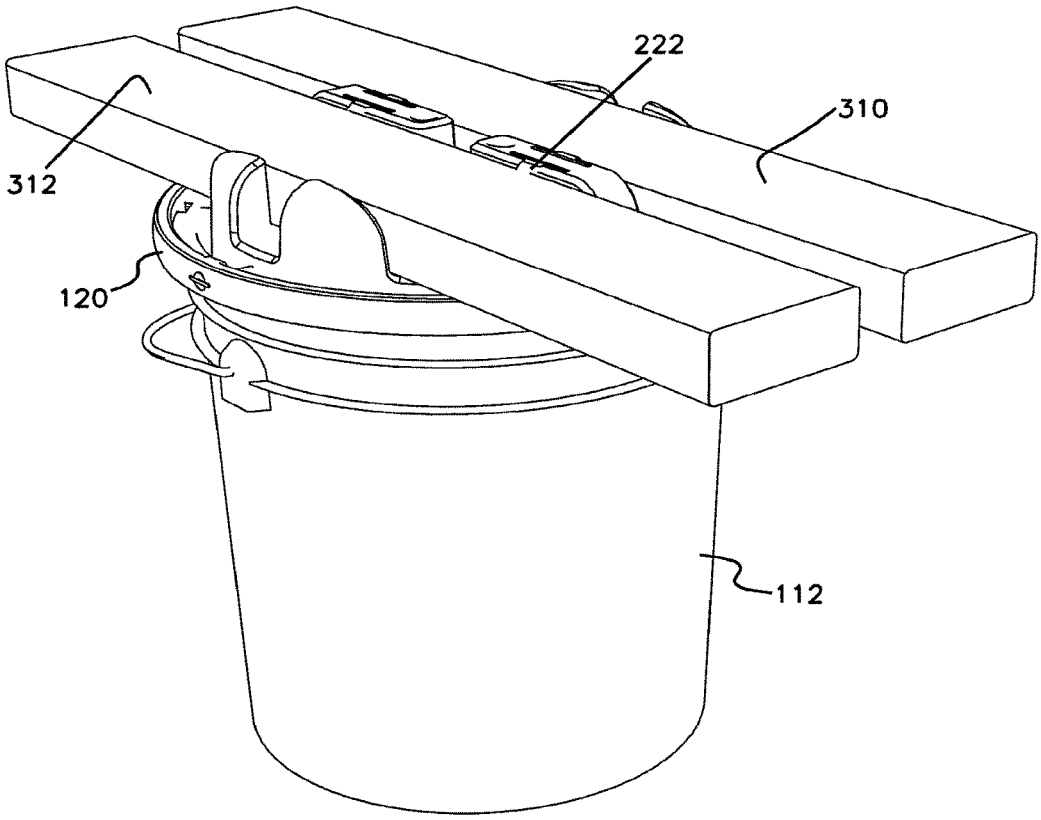
FIG. 12 shows a bucket with the connector of FIG. 5 and boards extending therefrom.
Figure 13:
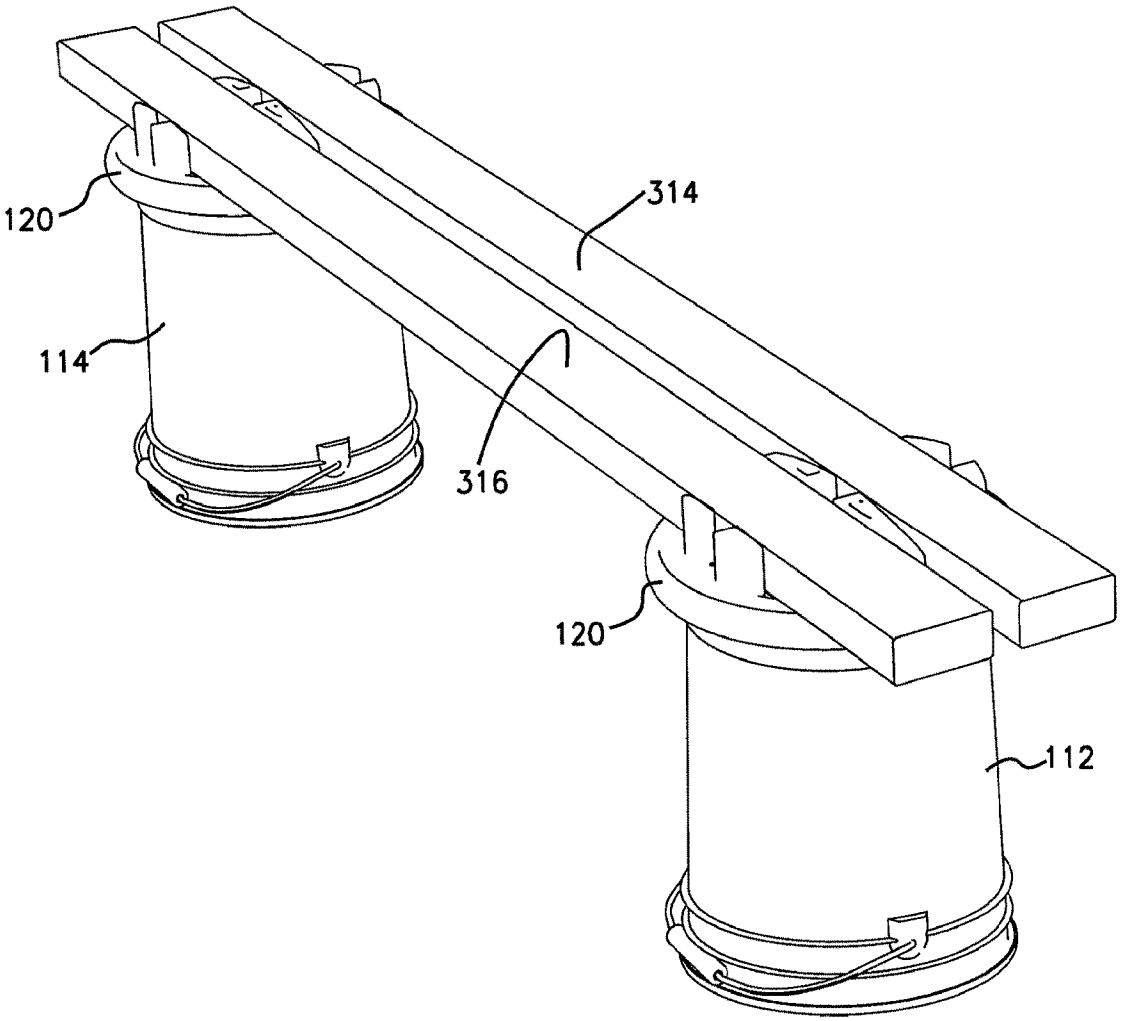
FIG. 13 shows two buckets with the connectors of FIG. 5 with boards extending therebetween.

For example, as shown in FIGS. 12 and 13, boards 310, 312 and 314, 316 are connected to connectors 120. The boards 310, 312, 314, 316 can be coupled and uncoupled from within the slots 210, 212 by sliding the boards into the slots 210, 212 so that the tabs 222 engage the boards.

Referring again to FIGS. 5-11, the connector 120 also includes a center slot 240 formed by protrusions 202, 203, 204, 205, 206, 208 for holding a cross member, such as a 2×4 piece of dimensional lumber of any length securely in the vertical orientation (with the 4" dimension perpendicular to the ground). In the example shown, the center slot 240 is oriented perpendicular to the slots 210, 212, although other orientations can also be used.

The connector 120 also includes recesses 250. The recesses 250 allow a fastener, such as a screw or nail, to be placed to securely connect the lumber to the connector 120.

Other configurations are possible. For example, the connector 120 can accommodate lumber of different sizes (e.g., 2×6, 4×6, etc.). In addition, the orientation and size of the slots can be modified, as described further below.

The second connector side 113 of the connector 120 also includes grooves 262 formed in an extension member 264. The grooves 262 are sized to receive horizontal pipes extending across the connector 120. See, e.g., FIG. 32. In addition, the connector 120 includes a groove 266 into which the open-end surface 114, 116 of each of the buckets 110, 112 can be inserted to couple the buckets to the connector 120. A diameter of an inner surface 268 of the extension member 264 is sized and tapered to engage the closed end 118 of the bucket 112 to form an interference fit.

Figure 14:
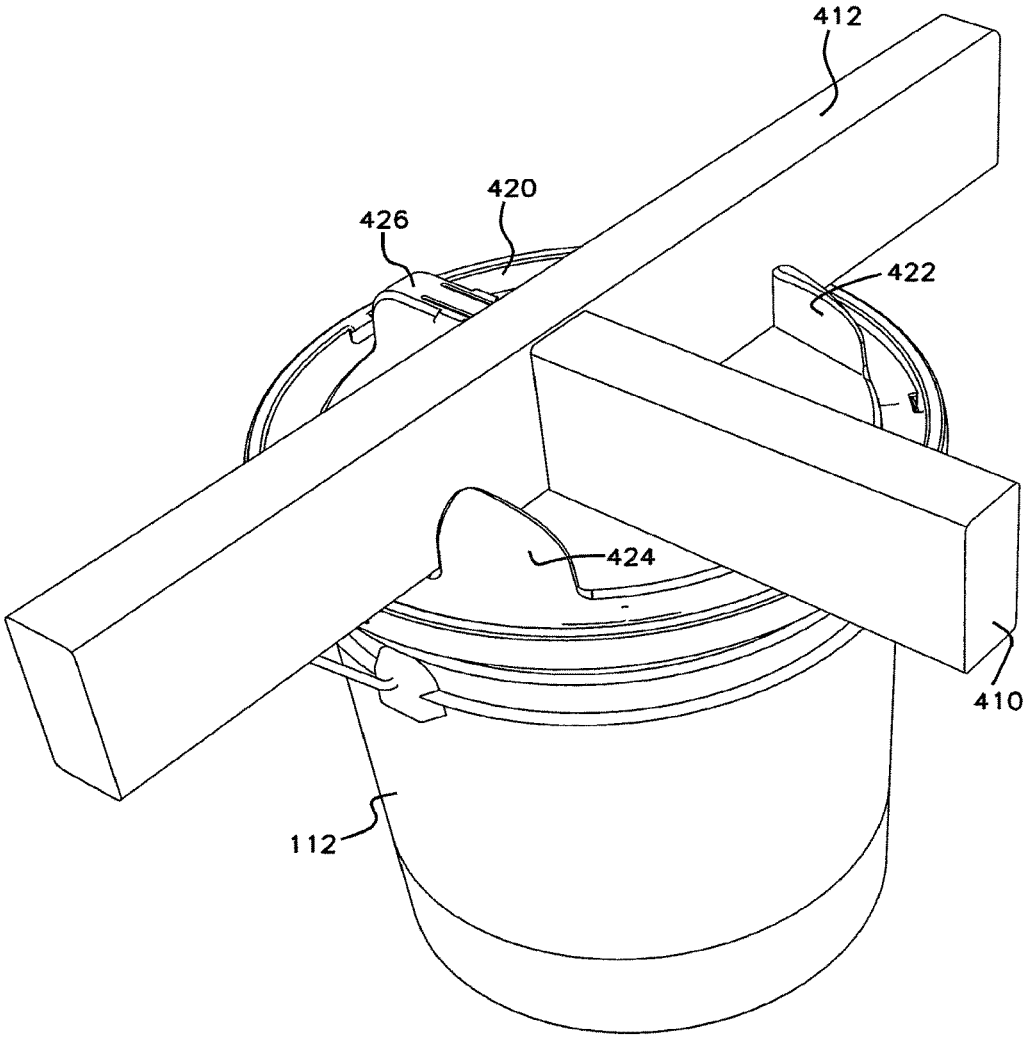
FIG. 14 shows a bucket with the connector of FIG. 5 and boards extending therefrom.
Figure 15:
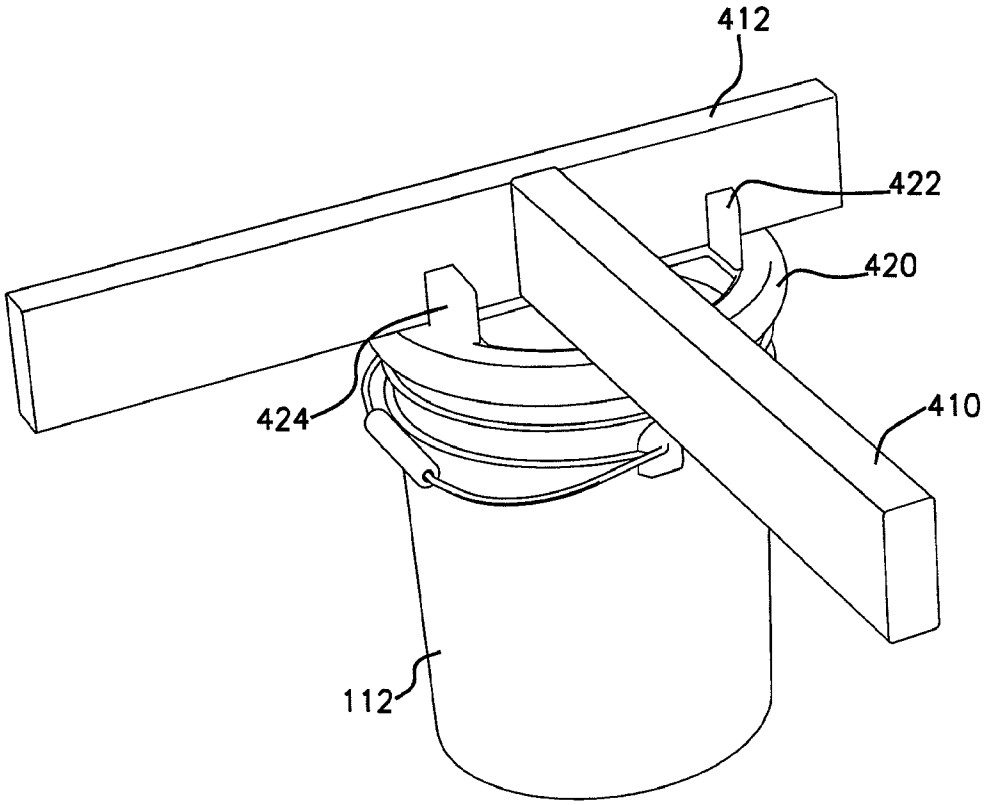
FIG. 15 shows the bucket, connector, and boards of FIG. 14.

Referring now to FIGS. 14 and 15, a connector 420 is shown. The connector 420 includes protrusions, 422, 424, 426 that allow two 2×4 boards 410, 412 to be connected to the connector 420 in a cross configuration. Other embodiments are possible. In these examples, the connectors 120, 420 can be configured to be connected to the top or bottom of the buckets 112, 114 while maintaining the structural and watertight integrity of the buckets. Heavy weight (water, rocks, screws, tools etc.) can be added to the buckets 112, 114 before the connector 120 is attached to add stability to the structure being built.

In other examples, the connectors can be ring-shaped or have alternative shapes. Additionally, the connectors can be adjustable. For example, two halves of a ring-shaped connector can separate and extend along a track, similar to extendable tables. In some embodiments, the connectors can be comprised of two halves that snap together near the center or are hinged near the center to enable the connector to fit inside of a bucket for easy transportation.

Figure 16:
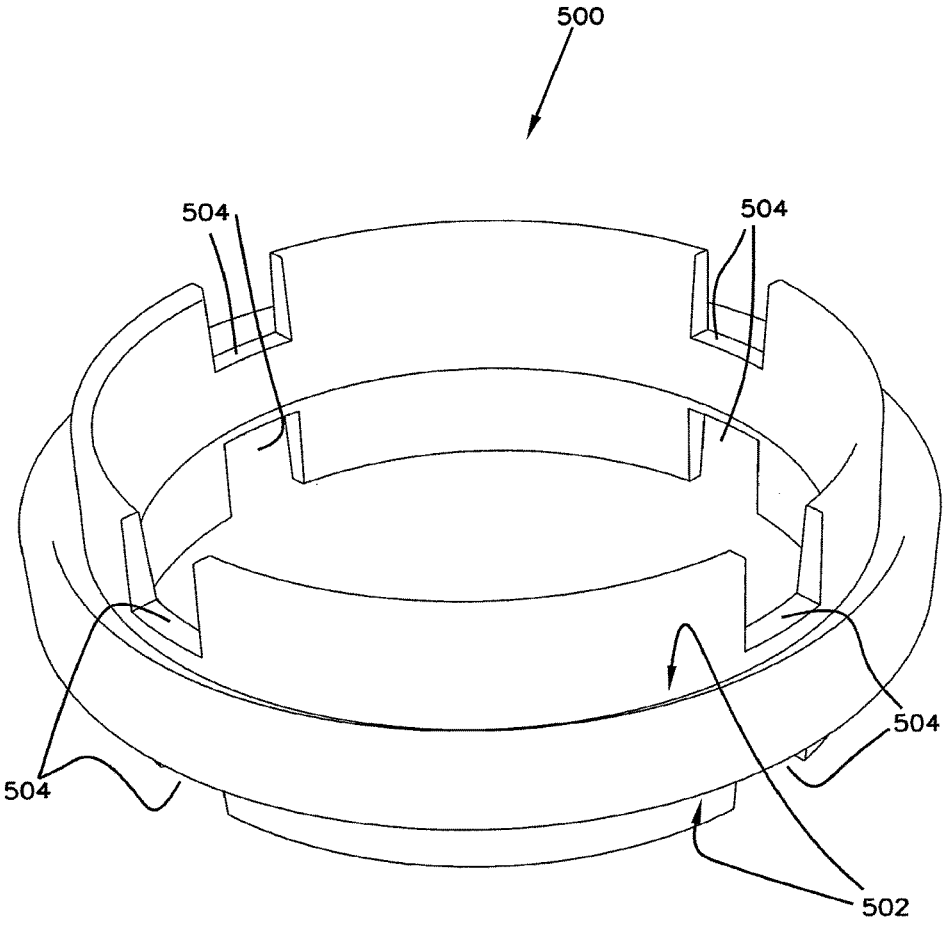
FIG. 16 shows another example connector.

In FIG. 16, a ring-shaped connector 500 is shown. The connector 500 includes a groove 502 formed on each side of the connector 500 so that one or two buckets can be coupled to the connector 500. In addition, the connector 500 forms opposing slots 504 on each side of the connector 500 so that a cross member, such as a 2×4 board, can be extended through the slots 504 to build structures.

The connectors need not be ring-shaped. Rather, single blocks, rectangular shapes, or organic forms can be equally effective.

Figure 17:
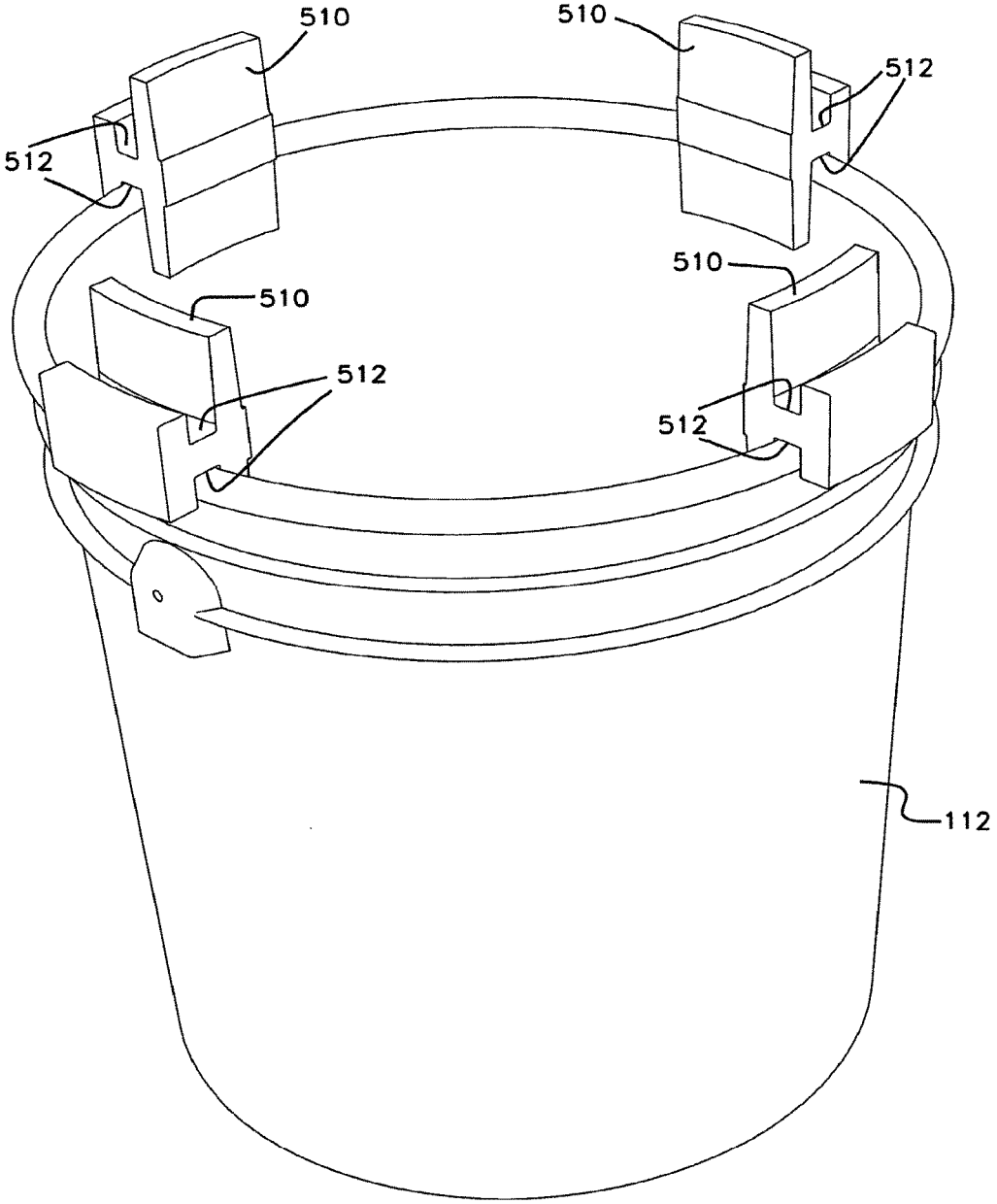
FIG. 17 shows other example connectors connected to a bucket.

For example, a single connector block 510, illustrated in FIGS. 17*b* and 17*c*, can be connected to a bucket alone or in pairs to control connection of the bucket to another bucket and/or the placement of lumber or pipe. For example, as shown in FIG. 17, connector blocks 510 are coupled at periodic intervals (e.g., at 90 degree intervals) along the open-end surface 116 of the bucket 112. Each of the connector blocks 510 defines grooves 512 in both sides of the blocks 510 to allow the blocks 510 to be coupled to the bucket 112. However, in one embodiment, each connector block 510 can define a groove 512 in only one side of the block 510. In some embodiments, the groove 512 in each side of a connector block 510 is created between arc-shaped, elevated walls that comprise part of the connector block 510, wherein the inner wall and the outer wall are of the same or differing heights. Further, in one embodiment, the inside facing surface of the connector block 510 can be tapered so that when two connector blocks 510 are positioned opposite each other on a bucket, they can engage the closed end 118 of the bucket 112 to form an interference fit. In another embodiment, the top and bottom of the inside facing surface of the connector block 510 can taper in and the middle of the inside facing surface of the connector block 510 can be flat.

In another example shown in FIGS. 18-21, rectangle connectors 530, 540 are configured to span the bucket diameter to control lumber and/or connect buckets together.

Figure 18:
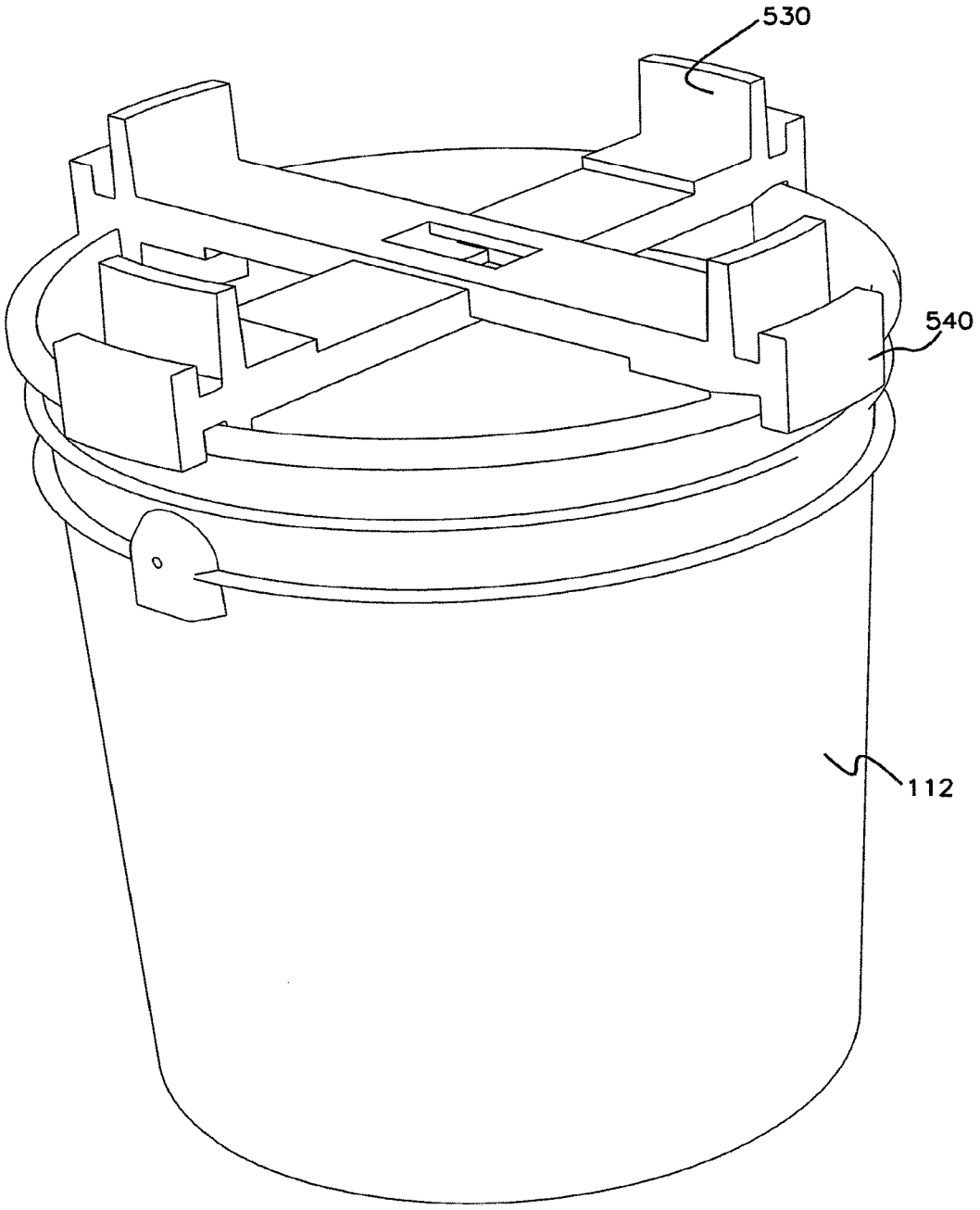
FIG. 18 shows other example connectors connected to a bucket.
Figure 19:
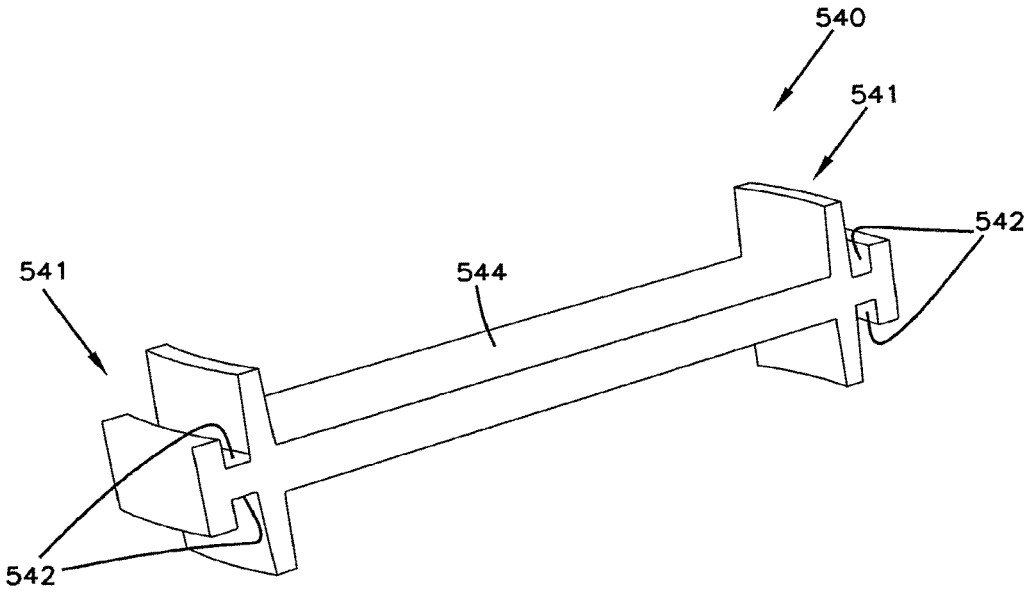
FIG. 19 shows one of the connectors of FIG. 18.
Figure 20:
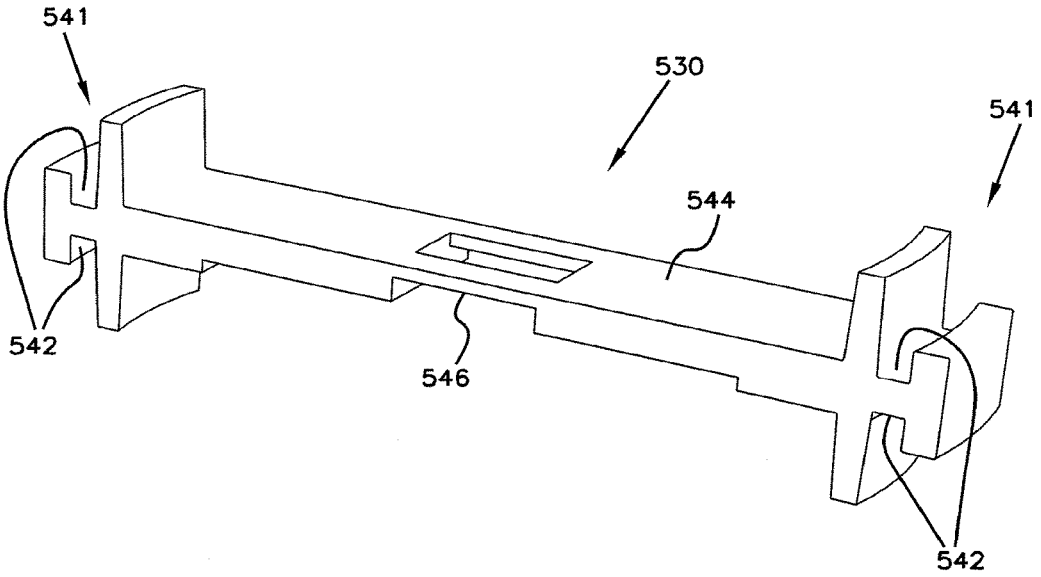
FIG. 20 shows one of the connectors of FIG. 18.
Figure 21:
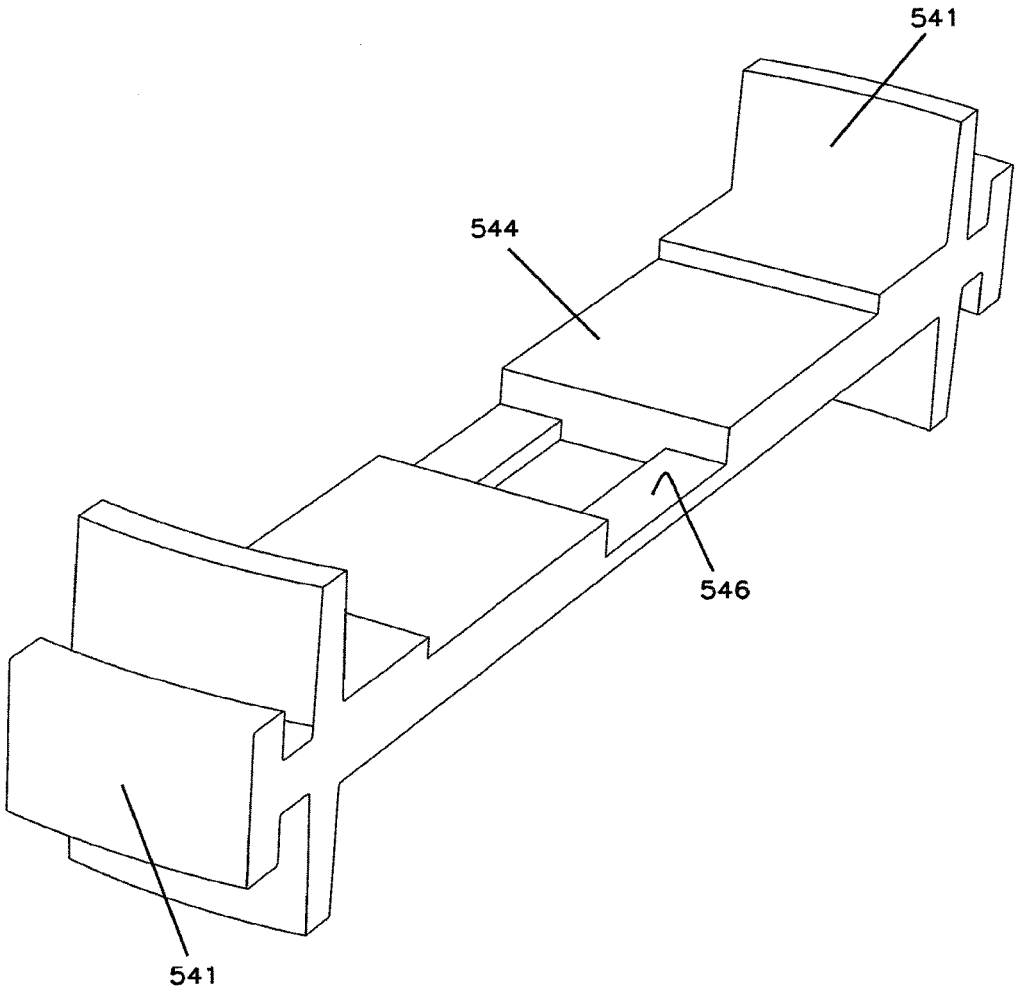
FIG. 21 shows the connector of FIG. 20.
Figure 22:
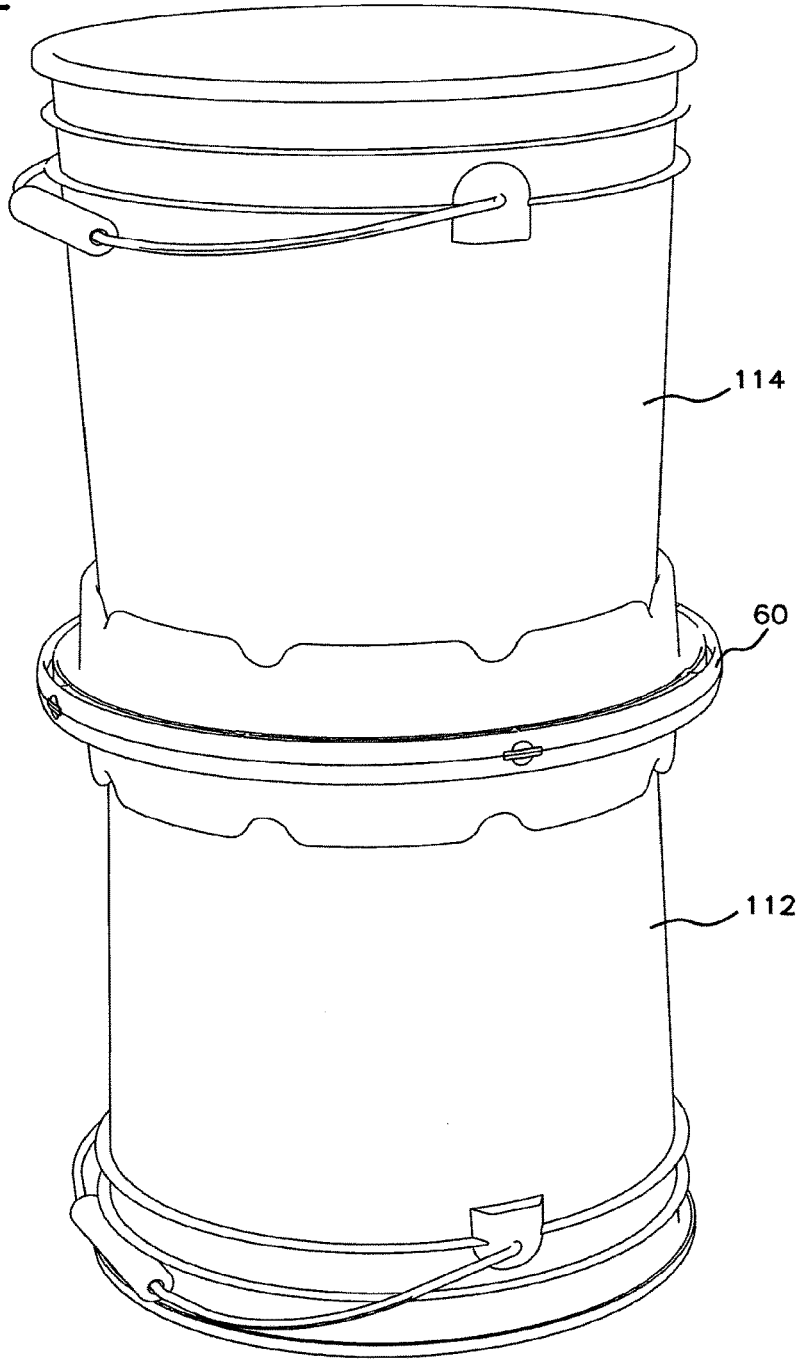
FIG. 22 shows two buckets connected by another example connector.

The connector 540 includes opposing side members 541 forming grooves 542 that are positioned to engage the open end surface 116 of the bucket 112. A cross-member 544 spans between the two side members 541. The connector 530 similarly includes side members 541 forming grooves 542. In addition, in one embodiment, the cross-member 544 spanning between the side members 541 can include a slot 546 to accept the cross-member 544 of another connector 540 when positioned at a 90-degree angle with respect to one another. In this embodiment, the slot 546 can be a hole or pass-through in the cross-member 544. Alternatively, the slot 546 can be a recess in the cross-member 544 that is of a length that allows the width of another connector 540 to fit in the recess, as illustrated in FIG. 18. In one embodiment, the slot 546 is located at or near the center of the cross-member 544. The cross-member 544 can further have a second, wider slot that is recessed, as illustrated in FIG. 20. In one embodiment, the surfaces of the side members that are facing inward toward the cross-member can be tapered to engage the closed end 118 of the bucket 112 to form an interference fit.

The rectangular shape of the connectors 530, 540 spans the bucket diameter with efficiency and can be used to control lumber or pipe singly or in pairs.

In the examples shown, any lumber coupled to the connectors 530, 540 intersects at right angles above the bucket. However, in alternative applications, angles less than or greater than ninety degrees may be used.

With the ability to make the above connections quickly, the users can create structural elements that can be configured intuitively and quickly to build a variety of useful structures.

For example, bucket to bucket connections allow one bucket to be joined to another so that they may be stacked. Bucket to bucket connections exist in four general forms: lid-to-lid (FIGS. 1-2), base-to-base (see connector 600 shown in FIG. 22), lid-to-base (FIGS. 3-4), and side-to-side.

Figure 23:
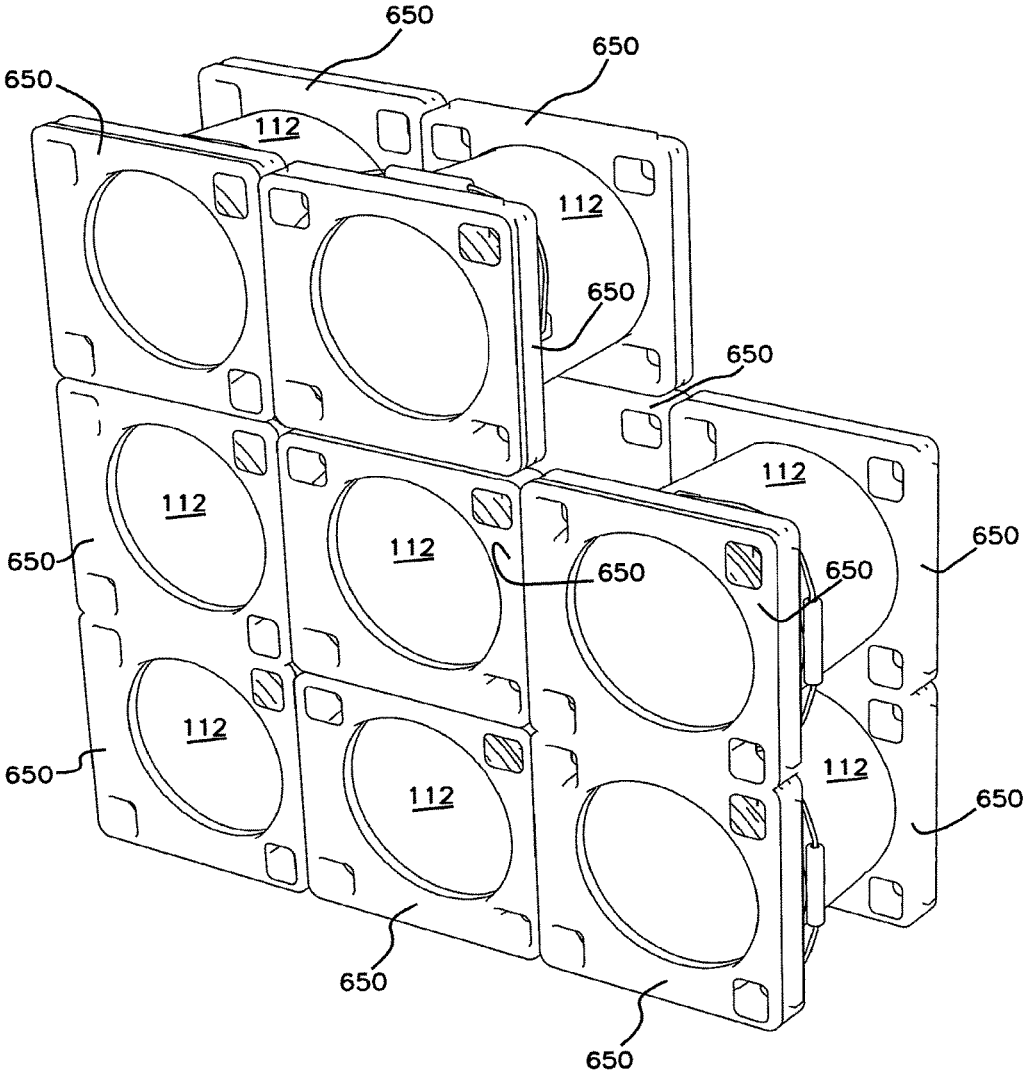
FIG. 23 shows a plurality of buckets connected by a plurality of connectors.
Figure 23B:
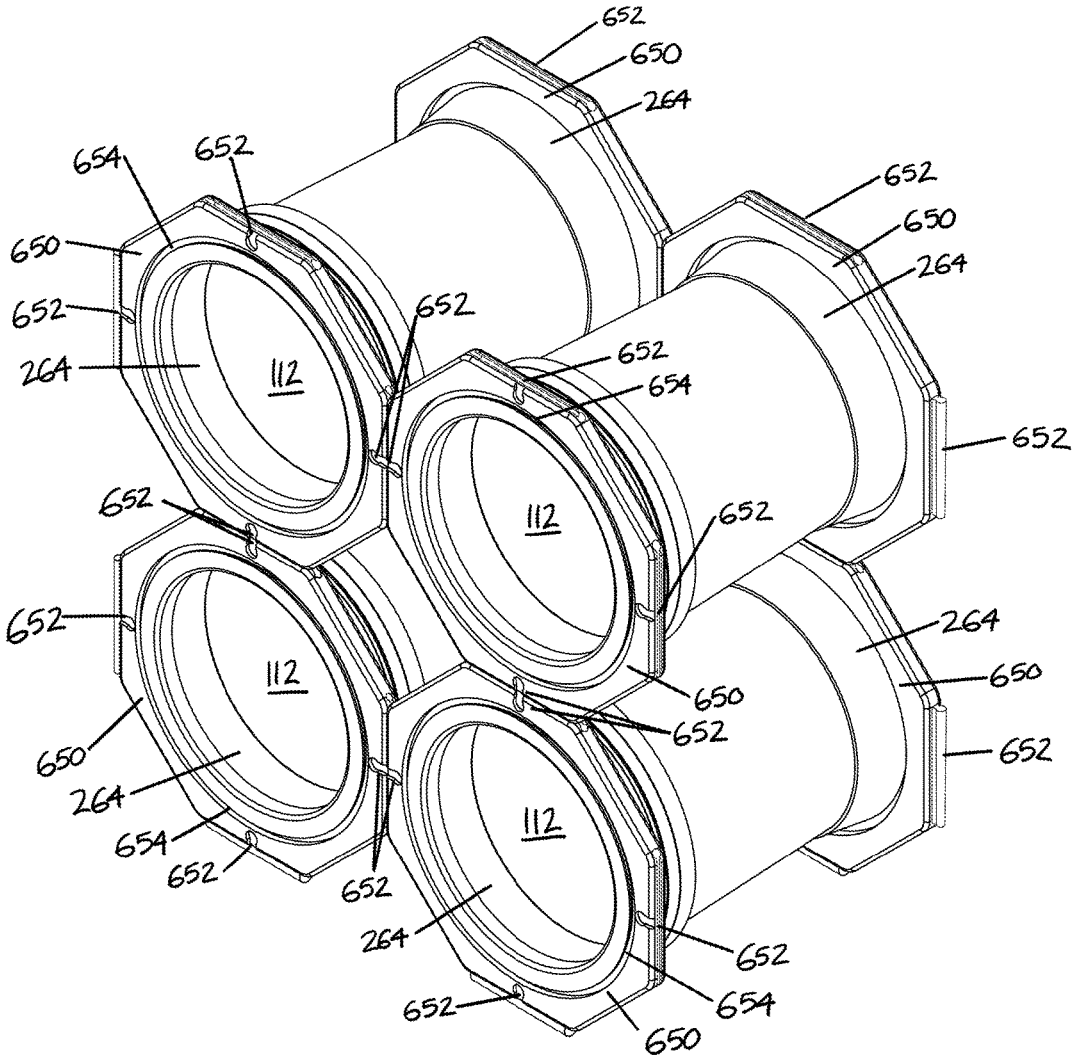
FIG. 23*b* shows a plurality of buckets connected by a plurality of connectors.
Figure 23C:
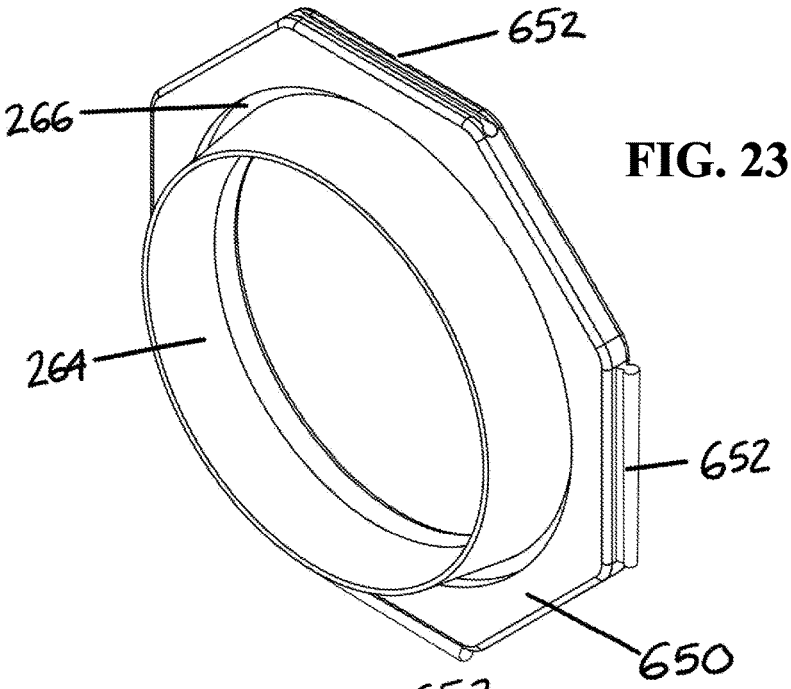
FIG. 23*c* shows a bottom perspective view of another example connector.
Figure 23D:
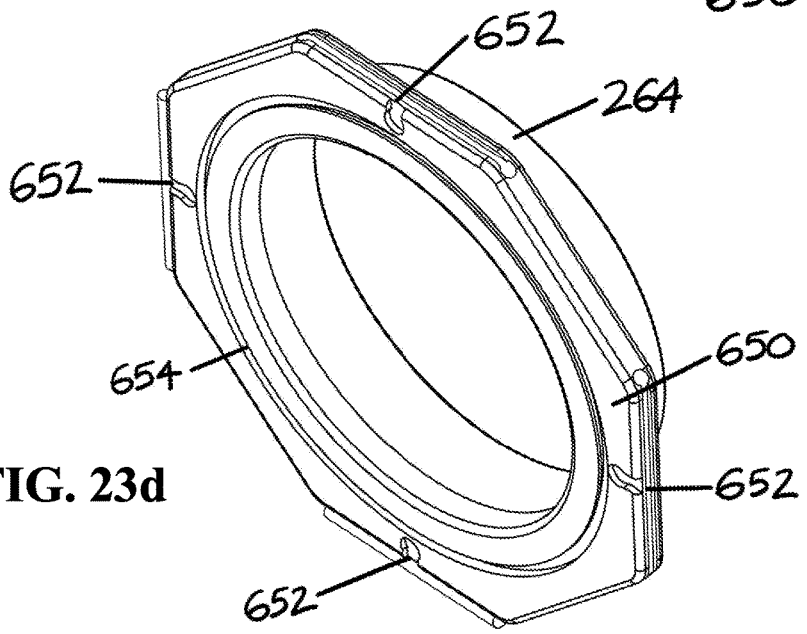
FIG. 23*d* shows a top perspective view of the connector of FIG. 23*c*.

As shown in FIGS. 23 through 23*d*, side-to-side connectors 650 connect buckets, not along the axis of the bucket as in the previously described connectors, but radial to the axis of the bucket, either with the lid ends facing the same direction or in opposite directions. These connectors 650 attach to the buckets in a manner consistent with the other connectors and attach to the adjacent connectors 650 by snaps or other locking mechanisms 652. For example, the connectors 650 can have a groove 266 on one or both sides of the device into which an open-end surface 114, 116 of each of the buckets 110, 112 can be inserted. Further, the connectors 650 can have a central, tapered hole or an extension member 264 to engage the closed end 118 of the bucket 112 to form an interference fit, as described above. Additionally, the outer rim of the connectors 650 can have a plurality of flats that allow each connector 650 to line up and attach to the adjacent connector 650. The connectors 650 can be squares, octagons, or other geometric shapes (such as triangles, hexagon, etc.). The connectors 650 can be used for building walls or storage bins, and can be made with lids and without. For example, as illustrated in FIG. 23*b*, the open-end surface 114, 116 of a bucket 112, can be inserted into a groove 266 on the first side of the connector 650 and the closed end 118 of the bucket 112 can engage an extension member 264 on the first side of the connector 650 to form an interference fit. Additionally, the second side of the connector 650 can have a top groove 654 that can connect to a lid.

Referring now to FIGS. 24-27, bucket-to-ground connections improve the interface between the bucket and the earth, floor, sidewalk, or street, etc. Bucket-to-ground connections exist in four general forms: stabilizing base, leveler, spiked, cushioned, wheeled or weighted bases, and variable angle base.

Figure 24:
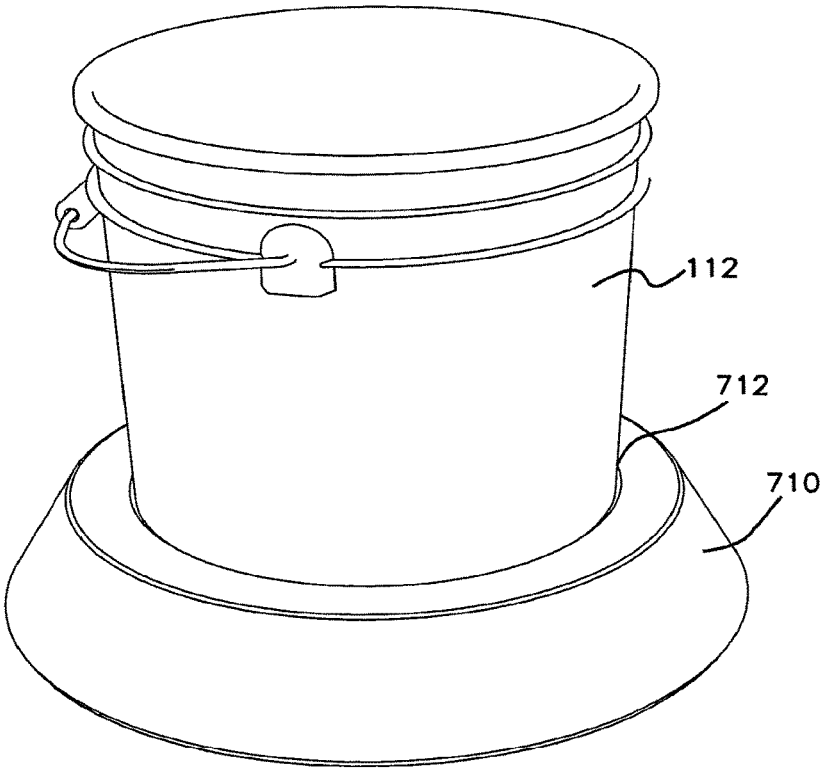
FIG. 24 shows a bucket with an example stabilizing base connector.

As shown in FIG. 24, a stabilizing base 710 includes an aperture 712 sized to receive a closed or open end of the bucket 112. The stabilizing base 710 is a connector that can be attached to either end of the bucket 112 to enlarge the footprint and add stability to the construct.

Figure 25:
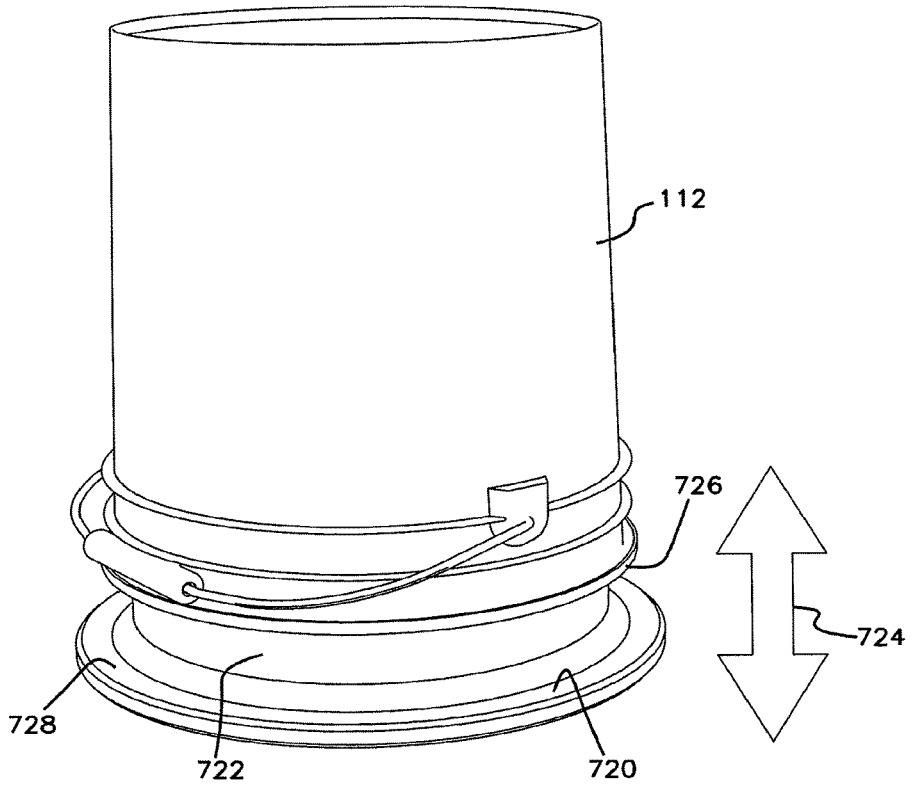
FIG. 25 shows a bucket with an example leveling base connector.

As shown in FIG. 25, a leveling base 720 is a two-part connector that allows a bucket column 722 to be raised or lowered in directions 724 relative to the ground. One side 726 of the base 720 connects to the bucket 112, while the other side 728 translates within that part and locks in continuous or discreet positions, effectively increasing or decreasing the distance from the bucket 112 to the ground. One translation mechanism is a large thread, although bayoneting or pinning the translating part into discreet positions could also be used.

Spiked, cushioned, wheeled, and/or weighted bases include special interfaces with the ground. It may be desirable to have bases with a cushioned, non-marring surface, or nonslip surface when working in doors. Alternatively, it may be desirable to have a spiked surface or a surface through which one may drive spikes for securing the construct when working on grass or diii. Adding casters for mobility or weight in the form of sand, water or metal may also add utility.

Figure 26:
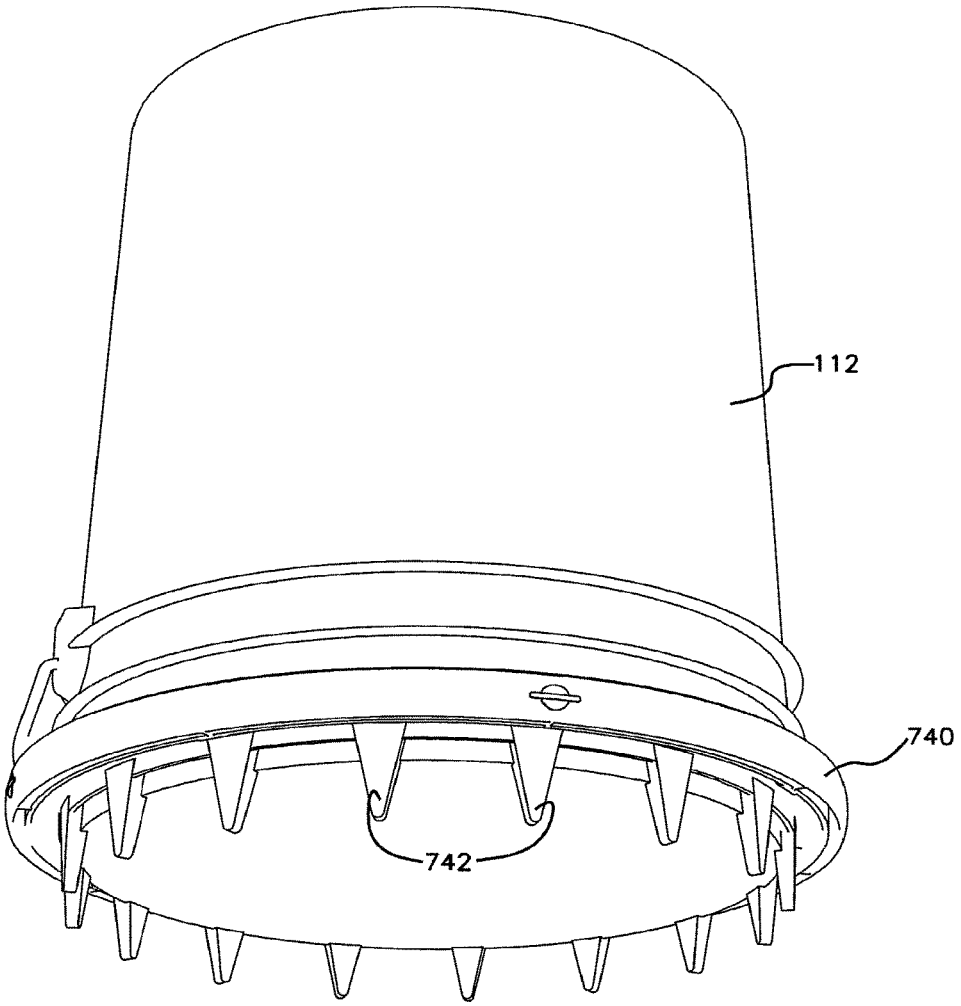
FIG. 26 shows a bucket with another example base connector with spikes.

For example, referring now to FIG. 26, a connector 740 includes a plurality of spikes 742 extending from the connector. The spikes 742 can be driven into a surface, such as dirt, to stabilize the connector 740 and attached bucket 112. The connector 740 can also include holes for driving stakes through the connector 740 and into the ground.

Figure 27:
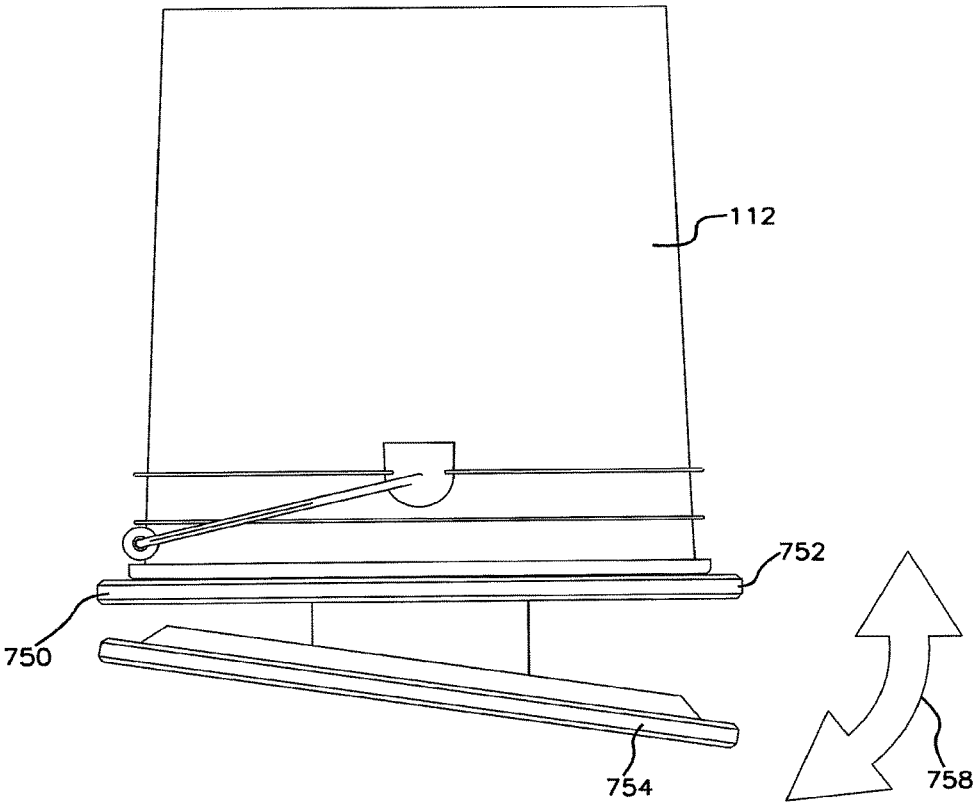
FIG. 27 shows a bucket with an example variable angle base connector.

In FIG. 27, a variable angle base 750 is used to level a construct on uneven ground. The base 750 includes a first part 752 that attaches to the bucket 112 and a second part 754 that rotates at an angle 758 relative to the first part 752 and interfaces with the ground. The second part 754 can rotate freely or be fixed in place at a discreet angle.

Bucket-to-lumber connections connect a bucket to dimensional lumber or sheathing. Types of bucket-to-lumber connections include: lumber-on-end, lumber-on-side, lumber vertical, joist hanger, and sheathing.

Examples of the lumber-on-end and lumber-on-side configurations are shown in FIGS. 12-15. Other configurations are possible.

Figure 28:
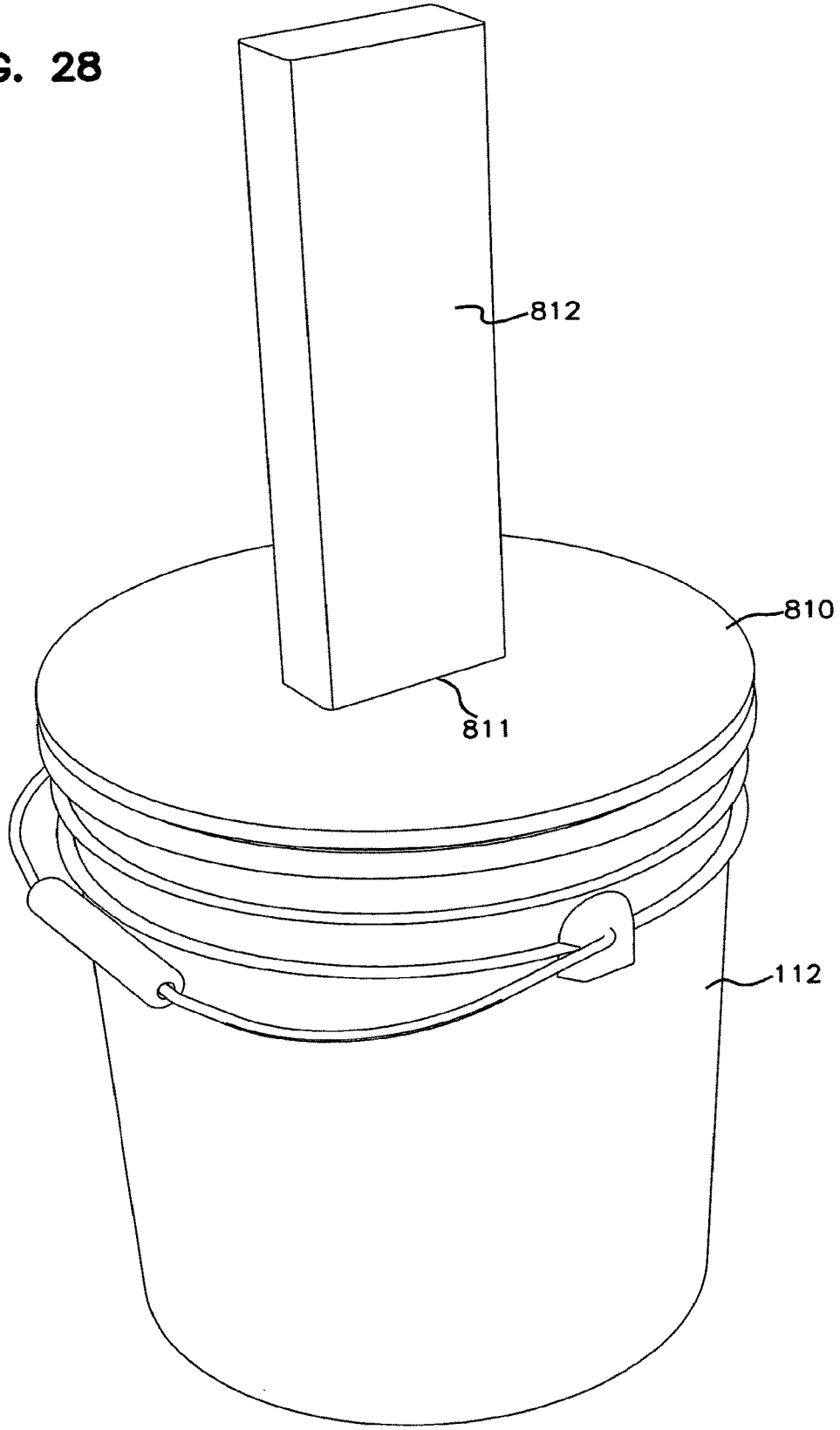
FIG. 28 shows a bucket with an example vertical lumber connector.

A vertical lumber connector 810 is shown in FIG. 28. The connector 810 allows the use of dimensional lumber 812 as a post, and the bucket 112 becomes a stable base for the post. The lumber 812 slides through an aperture 811 in the connector 810 and rests on the bottom of the bucket 112. Stability can be added by filing the bucket 112 with sand or gravel and by securing the post to the connector 810 with a fastener, such as a screw or clamp.

Figure 29:
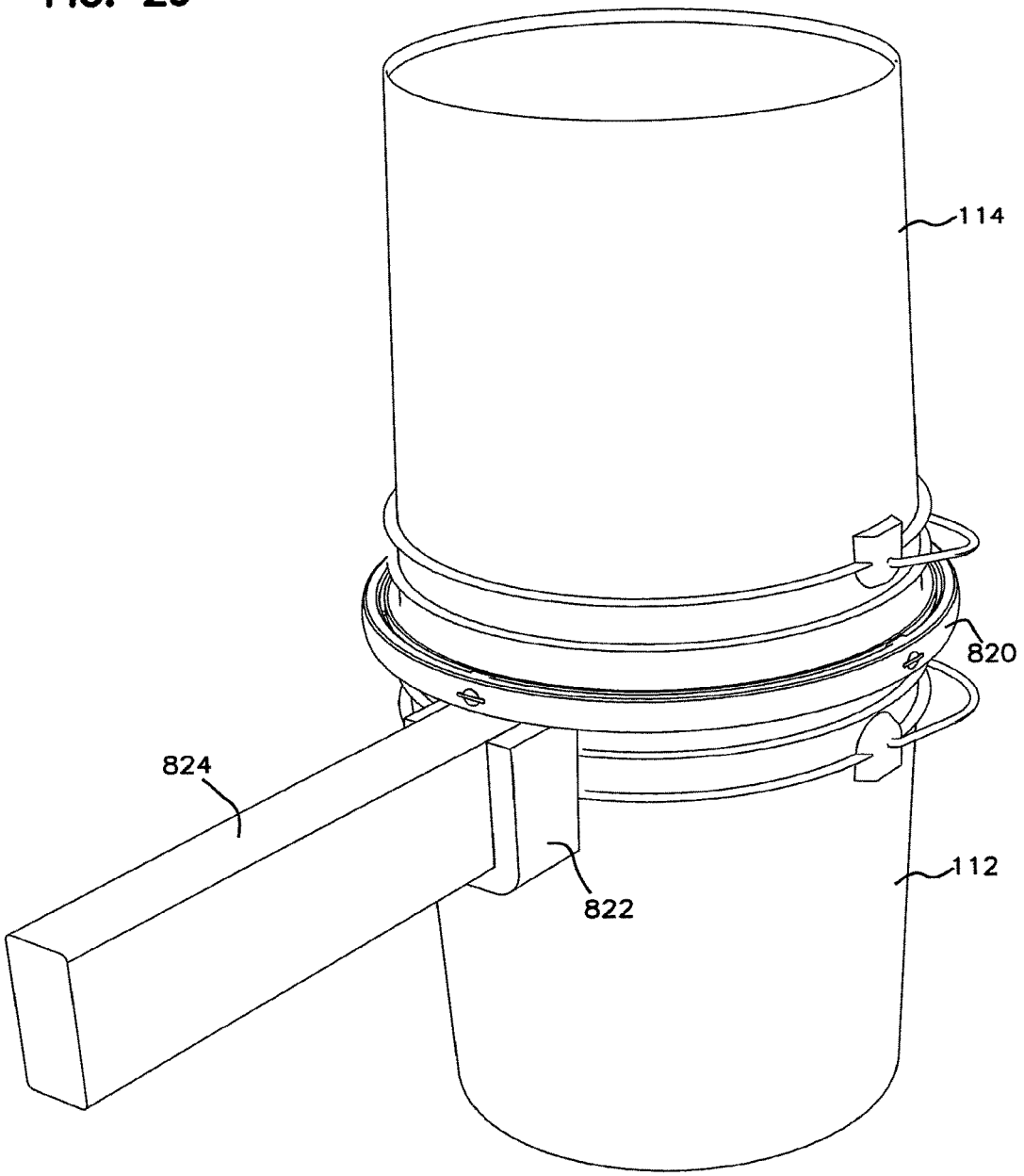
FIG. 29 shows a bucket with an example joist hanger connector.
Figure 30:
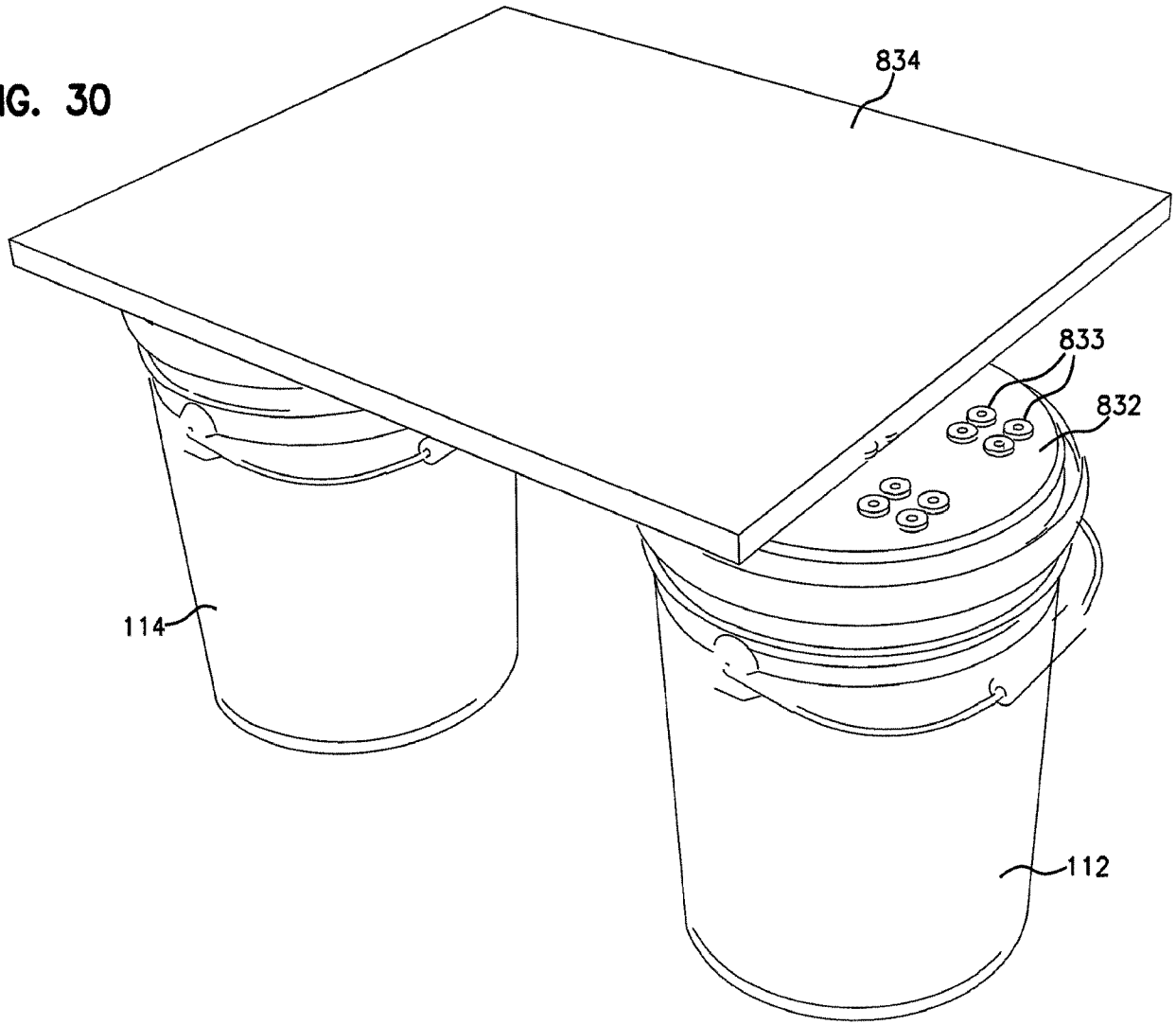
FIG. 30 shows a bucket with another example connector.

Referring now to FIG. 29, a joist hanger bucket connector 820 includes a pocket 822 positioned below the open-end surface 116 of the bucket 112. This allows the dimensional lumber 824 to be suspended from the side of the bucket 112 rather than pass the lumber 824 over the top of the bucket 112. This allows one to link one bucket column to another using lumber to add stability to the construct.

Plywood/sheathing connectors function similarly to dimensional lumber connectors, with the difference being the thickness of the board being accommodated. For example, in one alternative embodiment shown in FIG. 30, a connector 832 includes disks 833 that engage a bottom surface of a plywood sheet 834. The disks 833 have a roughened or sticky top surface that minimizes any tendencies of the sheet 834 to slip.

Bucket-to-pipe connections connect a bucket to a pipe. Types of bucket-to-pipe connections include vertical pipe and horizontal pipe. In some examples, pipe can include conduit through which a fluid could flow, as well as the handle of a rake or shovel, etc.

Figure 31:
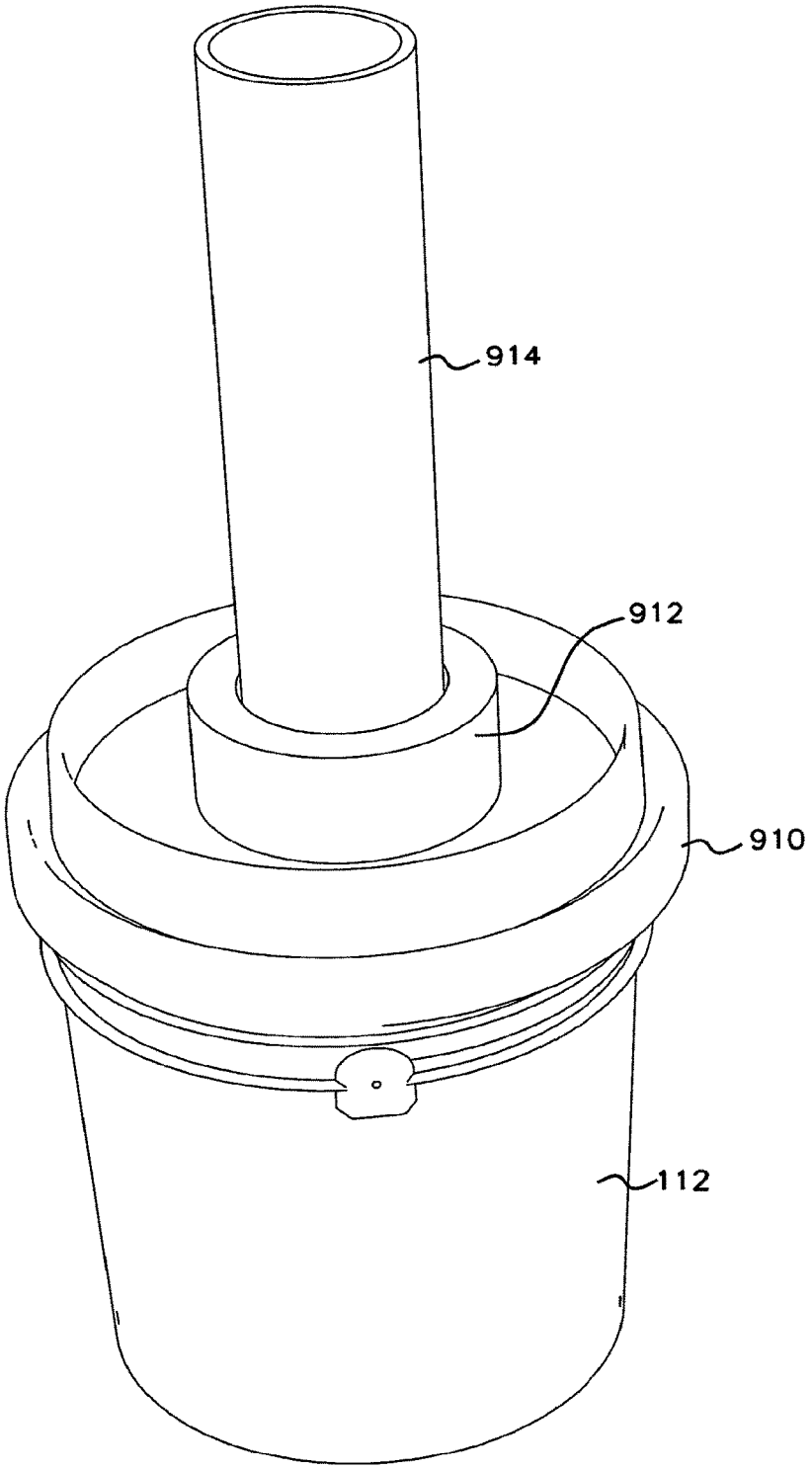
FIG. 31 shows a bucket with an example vertical pipe connector.

Referring to FIG. 31, a vertical pipe connector 910 allows one to use a pipe 914 as a post, and the bucket 112 becomes a stable base for the post. The pipe 914 slides through an aperture 912 formed in the connector 910 and rests on the bottom of the bucket 112. Stability can be added by filing the bucket 112 with sand or gravel and by securing the post to the connector 910 with a fastener, such as a screw, clamp or adhesive.

Figure 32:
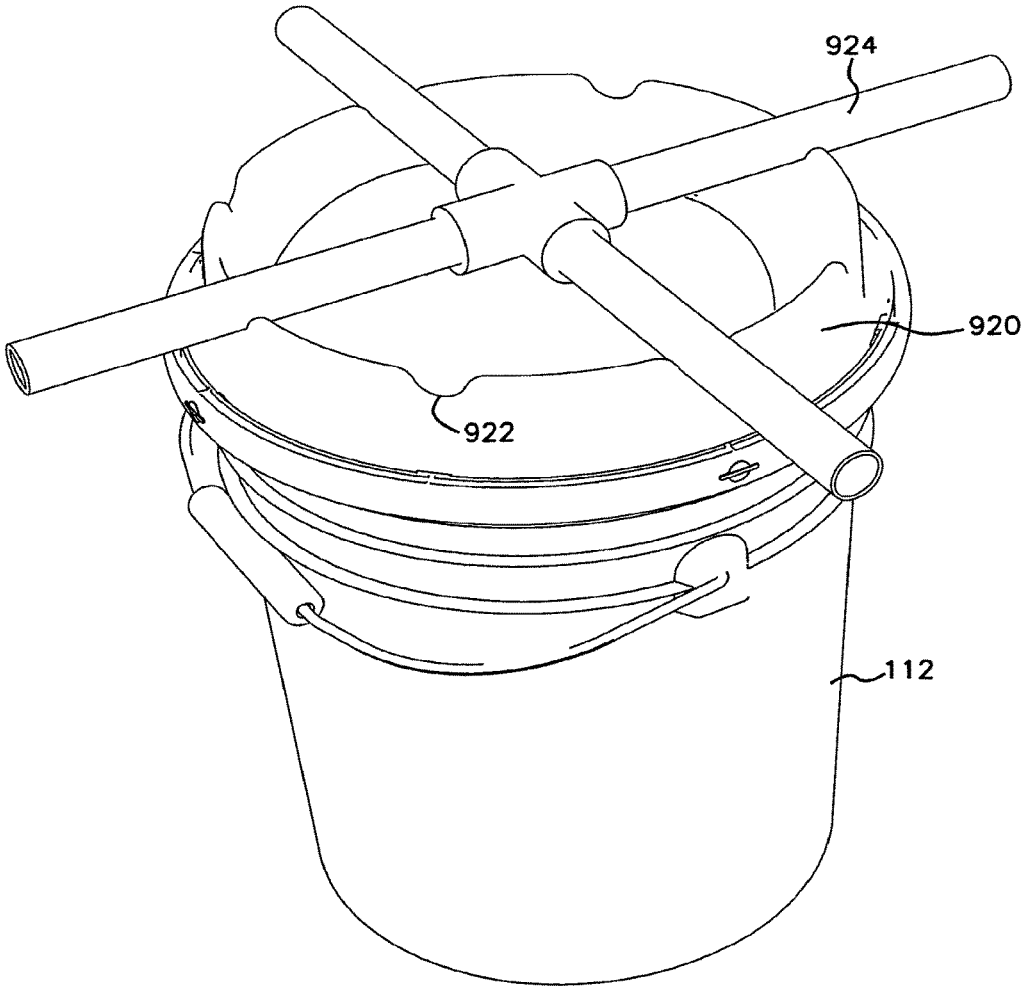
FIG. 32 shows a bucket with an example horizontal pipe connector.

Referring to FIG. 32, a horizontal pipe connector 920 allows one to attach pipes 924 to the bucket 112 in a horizontal orientation. One side of the connector 920 connects to the bucket 112, and the other side receives the pipes 924. The pipes 924 can rest within a semi-circular groove 922 formed in the connector 920, snap in place, or be slipped into a cylindrical receiver.

In some cases, it may be advantageous to connect bucket connectors to each other in order to support modularity or add degrees of freedom. Methods for achieving this may include threaded connections, snaps, latches, etc.

Figure 33:
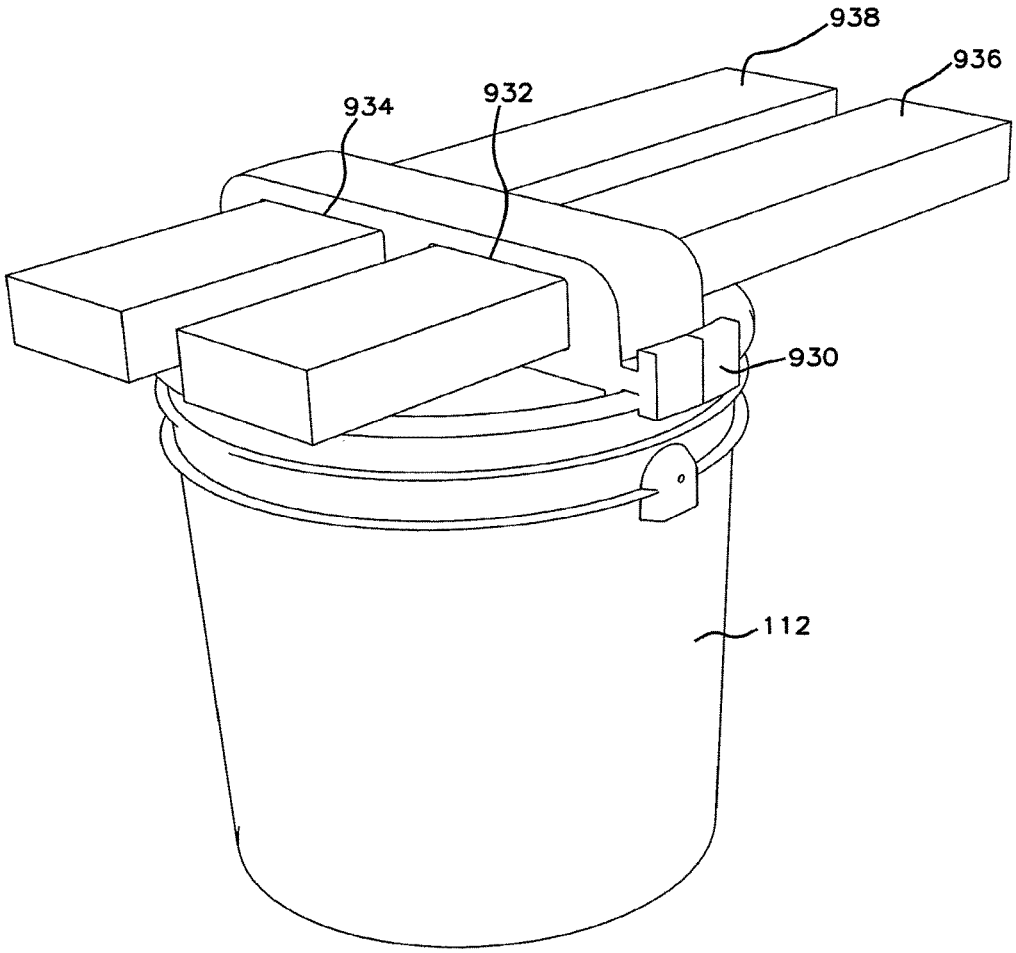
FIG. 33 shows a bucket with another example connector.

There are many methods by which the lumber can be captured by the connectors. The lumber can snap into place, latch in, be secured by fasteners (i.e. screws, nails), straps or adhesive, or enveloped by a connector 930, as shown in FIG. 33. The connector 930 defines two apertures 932, 934 through which 2×4 boards 936, 938 extend.

Figure 34:
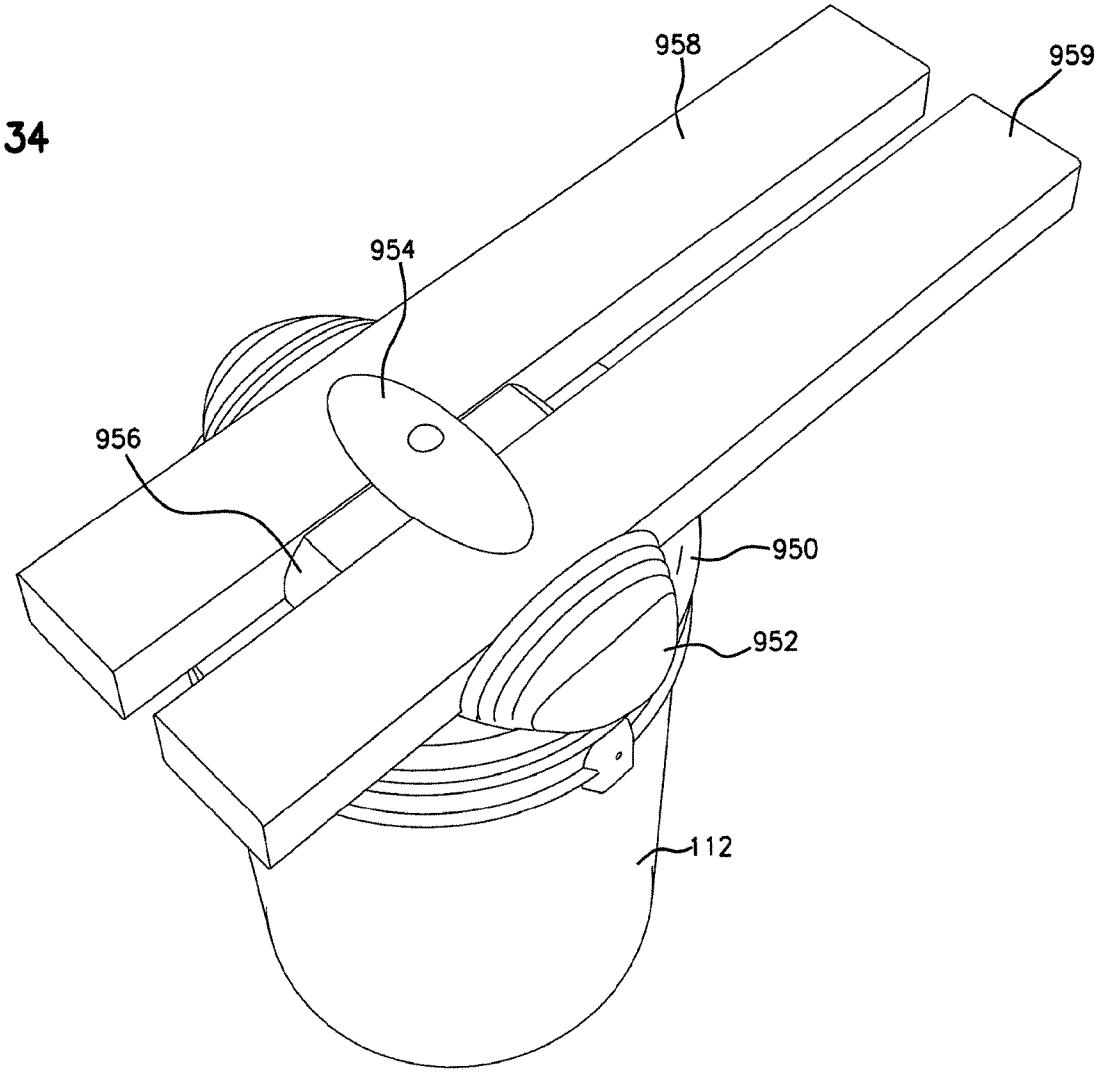
FIG. 34 shows a bucket with another example connector.

Referring to FIG. 34, another effective method of securing lumber 958, 959 to the bucket 112 is a connector 950 including a first part 952 that forms slots for the lumber 958, 959. A middle portion 956 of the connector 950 includes a second part 954 that rotates 90 degrees to capture (as shown) and release the lumber 958, 959.

Various embodiments are described above. These embodiments are examples only. Other variations are possible, and features of different embodiments can be combined to form other variations.

What is claimed is:

1. A device for connecting first and second tapered, cylindrical buckets together, each bucket having an open end surface with a diameter larger than that of an opposing closed end surface, the device comprising:

a first connector side;

a second connector side opposite the first connector side;

a first groove in the first connector side for receiving the open end surface of the first bucket;

a second groove in the second connector side for receiving the open end surface of the second bucket; and a lip formed around the outside of the device, wherein:

at least a first internal portion of the lip on the first connector side projects inward toward the first groove for snapping the device onto the open end surface of the first bucket and at least a second internal portion of the lip on the second connector side projects inward toward the second groove for snapping the device onto the open end surface of the second bucket.

2. The device of claim 1, further comprising a first extension member formed on the first connector side within the first groove, wherein an inner surface of the first extension member is tapered to create an interference fit with the closed end surface of the first bucket.

3. The device of claim 2, further comprising a second extension member formed on the second connector side within the second groove, wherein an inner surface of the second extension member is tapered to create an interference fit with a closed end surface of the second bucket.

4. The device of claim 3, further comprising at least one slot through at least one of the extension members, wherein the at least one slot is sized to receive a board.

5. The device of claim 2, further comprising at least one slot on the second connector side formed by at least two protrusions and sized to receive a board.

6. The device of claim 5, further comprising at least one tab on each of the protrusions extending into the at least one first slot to capture the board and couple to the board to the device.

7. The device of claim 5, further comprising a second slot on the second connector side sized to receive a board, the second slot extending perpendicularly with respect to the first slot.

8. A device for connecting first and second tapered, cylindrical buckets together, each bucket having an open end surface with a diameter larger than that of an opposing closed end surface, the device comprising:

a first connector side;

a second connector side opposite the first connector side;

a first extension member formed on the first connector side, wherein an inner surface of the first extension member is tapered to create an interference fit with the closed end surface of the first bucket; and a second extension member formed on the second connector side, wherein an inner surface of the second extension member is tapered to create an interference fit with the closed end surface of the second bucket.

9. The device of claim 8, further comprising at least one groove in the second extension member sized to receive a horizontal pipe extending across the device.

10. The device of claim 9, further comprising at least one groove in the first extension member sized to receive a horizontal pipe extending across the device.

11. The device of claim 8, further comprising at least one slot on the first extension member sized to receive a board.

12. The device of claim 11, further comprising at least one slot on the second extension member sized to receive a board.

13. A device for connecting first and second tapered, cylindrical buckets together, each bucket having an open end surface with a diameter larger than that of an opposing closed end surface, the device comprising:

a first connector side;

a second connector side opposite the first connector side;

a cross-member with a first and a second end;

a first side member connected to the first end of the cross-member;

a second side member connected to the second end of the cross-member;

a first groove in the first side member and on the first connector side for receiving the open end surface of the first bucket;

a first groove in the second side member and on the first connector side for receiving the open end surface of the first bucket;

a second groove in the first side member and on the second connector side for receiving the open end surface of the second bucket; and a second groove in the second side member and on the second connector side for receiving the open end surface of the second bucket;

wherein the device is configured to span the diameter of the open end surface of the first bucket and the open end surface of the second bucket.

14. The device of claim 13, wherein the cross-member is rectangular.

15. The device of claim 13, wherein the cross-member includes a slot located at the center of the cross-member.

16. The device of claim 15, wherein the slot is a hole.

17. The device of claim 15, wherein the slot is a recess in the cross-member.

18. The device of claim 15, wherein the slot is configured to receive an identical slot on a second device for connecting first and second tapered, cylindrical buckets together.

19. The device of claim 13, wherein the first and the second side members on the first connector side are tapered to form an interference fit with the closed end surface of the first bucket.

20. The device of claim 13, wherein the first and second side members are comprised of two elevated walls on each connector side, wherein each groove is formed between the two elevated walls and one or both of the elevated walls are arc shaped.

21. A connector block for connecting first and second tapered, cylindrical buckets together, each bucket having an open end surface with a diameter larger than that of an opposing closed end surface, the connector block comprising:

a first connector side;

a second connector side opposite the first connector side;

a first horizontal groove on the first connector side for receiving the open end surface of the first bucket; and a second horizontal groove on the second connector side for receiving the open end surface of the second bucket;

a rectangular, inside-facing surface, wherein the inside-facing surface is taller than it is wide; and a rectangular, outside-facing surface, wherein the outside-facing surface is wider than it is tall.

22. The connector block of claim 21, wherein the inside facing surface of the connector block is tapered.

23. The connector block of claim 21, wherein the connector block is comprised of two elevated walls on each connector side, wherein each groove is formed between the two elevated walls and one or both of the elevated walls are arc shaped.

24. A device for connecting tapered, cylindrical buckets together radially, each bucket having an open end surface with a diameter larger than that of an opposing closed end surface, the device comprising:

a first, rectangular connector side;

a second, rectangular connector side opposite the first connector side;

an outer rim with a plurality of flats;

a groove in the first, rectangular connector side for receiving the open end surface of a bucket;

a central, tapered hole in the first, rectangular connector side to create an interference fit with the closed end surface of the bucket; and a plurality of snaps located on the outer rim for connecting the device to a second device;

wherein the device connects to either the open end surface or the closed end surface of the bucket as well as to another, same device.

* * * * *